US011559465B2

(12) United States Patent
Ferracamo, Jr.

(10) Patent No.: US 11,559,465 B2
(45) Date of Patent: Jan. 24, 2023

(54) PASSIVE TEMPERATURE CONTROLLED CONTAINER

(71) Applicant: INMARK GLOBAL HOLDINGS, LLC, Austell, GA (US)

(72) Inventor: Jerry Louis Ferracamo, Jr., Acworth, GA (US)

(73) Assignee: INMARK GLOBAL HOLDINGS, LLC, Austell, GA (US)

( * ) Notice: Subject to any disclaimer, the term of this patent is extended or adjusted under 35 U.S.C. 154(b) by 313 days.

(21) Appl. No.: 16/799,027

(22) Filed: Feb. 24, 2020

(65) Prior Publication Data

US 2020/0206082 A1 Jul. 2, 2020

Related U.S. Application Data

(63) Continuation of application No. 15/178,198, filed on Jun. 9, 2016, now Pat. No. 10,568,808.

(60) Provisional application No. 62/173,526, filed on Jun. 10, 2015.

(51) Int. Cl.
*A61J 1/16* (2006.01)
*B65D 81/38* (2006.01)

(52) U.S. Cl.
CPC ..... *A61J 1/165* (2013.01); *B65D 81/3818* (2013.01); *B65D 81/3823* (2013.01)

(58) Field of Classification Search
CPC . A61J 1/165; B65D 81/3818; B65D 81/3823; B65D 81/382; B65D 81/383; B65D 81/3832; B65D 81/3825; B65D 81/3813; B65D 81/38
See application file for complete search history.

(56) References Cited

U.S. PATENT DOCUMENTS

2014/0367393 A1* 12/2014 Ranade ..... B32B 37/12 220/592.25
2015/0232266 A1* 8/2015 Ahmed ..... F25D 3/06 165/104.34
2016/0145029 A1* 5/2016 Ranade ..... B65D 19/0095 220/4.01
2017/0349356 A1* 12/2017 Dudi ..... B65D 25/16

* cited by examiner

*Primary Examiner* — Don M Anderson
(74) *Attorney, Agent, or Firm* — Troutman Pepper Hamilton Sanders LLP; James E. Schutz; Nicholas H. Doss

(57) ABSTRACT

The disclosed technology includes a passive temperature controlled container for passively maintaining a specified temperature range in a storage chamber of the container for a predetermined amount of time. The passive temperature controlled container may be configured to have an inner PCM layer and an outer PCM layer, with an air chamber layer between the two PCM layers to allow for the free movement of air around all six sides of the container.

17 Claims, 17 Drawing Sheets

PASSIVE TEMPERATURE CONTROLLED CONTAINER

CROSS REFERENCE TO RELATED APPLICATION

This application is a continuation application claiming priority under 35 U.S.C. § 120 to U.S. patent application Ser. No. 15/178,198 entitled "PASSIVE TEMPERATURE CONTROLLED CONTAINER," filed 9 Jun. 2016, which claims benefit under 35 U.S.C. § 119(e), of U.S. Provisional Patent Application No. 62/173,526 filed 10 Jun. 2015, entitled "PASSIVE TEMPERATURE CONTROLLED CONTAINER," the entire contents and substance of which is incorporated herein by reference in its entirety as if fully set forth below.

TECHNICAL FIELD

Aspects of the present disclosure relate to containers for shipping goods, and, more particularly, systems and methods for passively controlling shipping container temperatures.

BACKGROUND

In the shipping industry, there often arises a need for rigid shipping containers to transport cargo in a temperature-controlled manner. For example, products related to pharmaceuticals, biotechnology, clinical trials, biologics, tissues, and derma patches not only must be transported within a specific temperature range in order to maintain the integrity of the product, but are also often required to be so transported in accordance with laws, regulations, or other guidelines. For example, the ICH stability guidelines dictate the storage conditions at which various drug products must be maintained. Furthermore, if a container is shipped from one environment to another (e.g., a hot environment to a cold environment), the external temperature forces acting on the exterior of the container may vary drastically during a single trip. Thus, there is a significant need in the market for reliable, temperature-controlled shipping containers.

Traditionally, temperature-controlled shipping containers come in two types—active temperature control and passive temperature control. Active temperature control containers can be electronically controlled devices that continually monitor and adjust the temperature of the container using, for example, compressor cooling and electric heating. These systems rely on electricity to function properly and may use dry ice as a coolant to push cool air into the payload area of the container. By contrast, passive systems are typically designed to maintain a particular temperature range for up to a predetermined amount of time, by incorporating gel packs or other types of phase change materials into the container. For example, a passive system may be capable of maintaining a given temperature range for up to 24 hours, 72 hours, or 96 hours.

Both active and passive systems have advantages and drawbacks. Passive systems are only good for a generally shorter, predetermined amount of time and must be configured properly with the right materials based on the requirements of the payload. However, active systems are typically much more expensive, and because they rely on a power source, they present a risk of damage to the payload if the power source supporting the container goes down.

Thus, it would be desirable to develop an improved passive temperature-controlled container for regulating a payload's temperature within a specified range, for an extended period of time, that can be achieved inexpensively compared to other solutions.

BRIEF DESCRIPTION OF THE FIGURES

Reference will now be made to the accompanying figures, which are not necessarily drawn to scale, and wherein.

DETAILED DESCRIPTION

Figure 1:
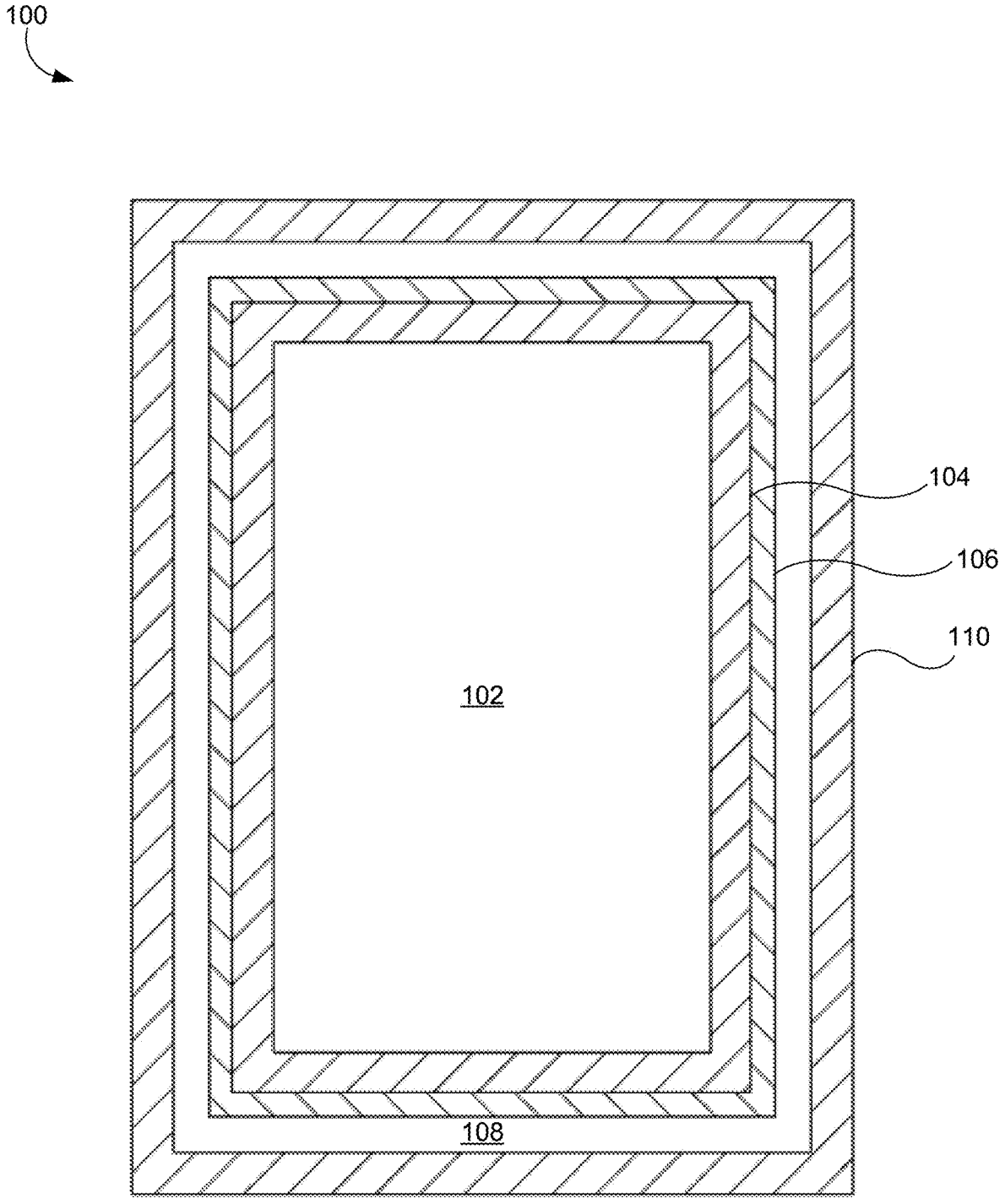
FIG. 1 is an illustration of a conceptual representation of a passive temperature controlled container, in accordance with an example embodiment of the presently disclosed subject matter.

The present disclosure can be understood more readily by reference to the following detailed description of exemplary embodiments and the examples included herein. Before the exemplary embodiments of the devices and methods according to the present disclosure are disclosed and described, it is to be understood that embodiments are not limited to those described within this disclosure. Numerous modifications and variations therein will be apparent to those skilled in the art and remain within the scope of the disclosure. It is also to be understood that the terminology used herein is for the purpose of describing specific embodiments only and is not intended to be limiting. Some embodiments of the disclosed technology will be described more fully hereinafter with reference to the accompanying drawings. This disclosed technology may, however, be embodied in many different forms and should not be construed as limited to the embodiments set forth herein.

In the following description, numerous specific details are set forth. However, it is to be understood that embodiments of the disclosed technology may be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Unless otherwise noted, the terms used herein are to be understood according to conventional usage by those of ordinary skill in the relevant art. In addition to any definitions of terms provided below, it is to be understood that as used in the specification and in the claims, "a" or "an" can mean one or more, depending upon the context in which it is used. Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

Also, in describing the exemplary embodiments, terminology will be resorted to for the sake of clarity. It is intended that each term contemplates its broadest meaning as understood by those skilled in the art and includes all technical equivalents that operate in a similar manner to accomplish a similar purpose.

To facilitate an understanding of the principles and features of the embodiments of the present disclosure, exemplary embodiments are explained hereinafter with reference to their implementation in illustrative embodiments. Such illustrative embodiments are not, however, intended to be limiting.

The materials described hereinafter as making up the various elements of the embodiments of the present disclosure are intended to be illustrative and not restrictive. Many suitable materials that would perform the same or a similar function as the materials described herein are intended to be embraced within the scope of the exemplary embodiments. Such other materials not described herein can include, but are not limited to, materials that are developed after the time of the development of the invention, for example.

Embodiments of the disclosed technology include a passive temperature controlled container for passively maintaining the temperature range of cargo during transportation. In various embodiments, a passive temperature controlled container may maintain an internal temperature within a predetermined range, for a specified amount of time without any outside intervention. According to some embodiments of the present disclosure, a passive temperature controlled container may maintain a temperature within a substantially constant temperature range within the storage area of the container by passively generating a temperature stabilizing air flow around all sides of the container.

Throughout this disclosure, certain embodiments are described in exemplary fashion in relation to a mid-sized container designed to maintain an internal temperature in the cargo region of the container of between 2° C.-8° C. for up to 120 hours. However, embodiments of the disclosed technology are not so limited. In some embodiments, the disclosed technique can be effective in maintaining a specified temperature range for a specified period of time in both smaller or larger sized containers. Further, in some embodiments, the disclosed technique can be effective in maintaining different ranges of temperatures. For example, in some embodiments a passive temperature controlled container can maintain temperature ranges including 2° C.-25° C., 15° C.-25° C., or less than −20° C. over a specified period of time. Also, embodiments of the present disclosure can be effective in maintaining a specified temperature range for different lengths of time, including up to 72 hours, up to 96 hours, and more than 120 hours. The ultimate length of time a passive temperature controlled container can maintain a specified temperature range within the storage chamber may vary slightly based on whether the container is transported through hot or cold climates, but according to embodiments of the present disclosure, a passive temperature controlled container can be configured to predictably maintain a temperature within a steady range for at least the specified time frame.

Referring now to the drawings, FIG. 1 illustrates a conceptual embodiment of a passive temperature controlled container. Although FIG. 1 does not reflect an accurate representation of a physical structure of an embodiment of a passive temperature controlled container, FIG. 1 illustrates the conceptual layers present within the structure of embodiments of a passive temperature controlled container. In the center of a passive temperature controlled container may be a storage chamber 102, configured to hold cargo or a payload to be shipped. Surrounding the storage chamber 102 can be an inner PCM layer 104. The inner PCM layer 104 represents an inner phase change material or refrigerant. A phase change material ("PCM") can be a substance having a high heat of fusion, which is capable of storing and releasing energy. For example, heat can be released when a PCM freezes and conversely heat can be absorbed when a PCM melts. A PCM can have a "melting temperature" or "phasing temperature" that signifies the temperature at which the PCM will change phase (e.g., melt from solid to liquid). It should be understood that although not depicted in FIG. 1, the various layers described herein can include various panels, walls, or insulation that may partially or entirely separate the layers from one another. For example, in some embodiments the inner PCM layer 104 may have wooden or cardboard paneling that can shield the cargo in storage chamber 102 from making contact with the PCM (or PCM containers) of the inner PCM layer 104. It should be understood that although this disclosure describes that one conceptual layer may "surround" another conceptual layer (e.g., the inner PCM layer 104 surrounds the storage chamber 102), this is not intended to indicate that the inner layer is entirely physically surrounded by a particular substance or material of the outer layer, but rather the inner layer may only be partially physically surrounded by a particular substance or material of the outer layer.

As shown in FIG. 1, a buffer layer 106 can surround the inner PCM layer 104. A buffer layer can serve to separate the inner PCM layer 104 from the air chamber layer 108, which surrounds the buffer layer 106. Surrounding the air chamber layer 108 is an outer PCM layer 110. The outer PCM layer 110 represents an outer phase change material or refrigerant. According to some embodiments, the outer PCM layer 110 can be surrounded by a layer of insulation. According to some embodiments, the inner PCM layer 104 can include a refrigerant such as a PCM having a specified phasing temperature, and the outer PCM layer 110 can be a water-based refrigerant, such as ice. Convection can occur in the air chamber layer 108 induced by the temperature differentials between the inner PCM layer 104 and the outer PCM layer 110 as well as gradients created by temperature influences external to the container. The convection will cause air to flow around all sides of the container, thereby substantially evenly distributing heat around the container and maintaining a substantially constant temperature on all sides of the container, despite the fact that there may be localized temperature impacts on the outside of the container. For example, if one portion of the container experiences heat from an external source, this may cause a gradient that can create convection currents and air flow that can act to distribute the heat evenly and substantially automatically normalize the temperature of the container across all sides of the container.

As will be understood by those of skill in the art, the purpose of the inner PCM layer 104 can be to stabilize the temperature of the storage chamber, while the purpose of the outer PCM layer 110 can be to provide a cooling effect. As such, a PCM of the inner PCM layer 104 can be referred to as a stabilizing PCM and a PCM of the outer PCM layer 110 can be referred to as a cooling PCM. According to some embodiments, an inner PCM material can be placed in the inner PCM layer 104 in a thawed state such that it may be cooled via heat exchange with the outer PCM layer 110. According to some embodiments, heat can be exchanged between the inner PCM layer 104 and the outer PCM layer 110 via the air chamber layer 108. According to some embodiments, the outer PCM layer 110 can act to cool the inner PCM layer 104, causing the inner PCM layer 104 to release heat and decrease in temperature. As heat transfer occurs between the inner PCM layer 104 and the outer PCM layer 110, the inner PCM material can decrease in temperature, approaching its phasing temperature. According to some embodiments, as the inner PCM material approaches its phasing temperature, the temperature of the inner PCM material may tend to stabilize at or around the phasing temperature for an extended period of time as heat exchange continues to occur between the inner PCM layer 104 and the outer PCM layer 110. In this way, the inner PCM layer 104 acts to stabilize the temperature of the cargo at the desired temperature range as long as the inner PCM layer 104 maintains a substantially constant temperature. For example, in some embodiments, a temperature may be substantially constant if the temperature stays within a specified range, such as, for example, between 2° C.-8° C.

Thus, according to some embodiments, an inner PCM layer having a particular phasing temperature can serve to consistently keep the temperature of the storage chamber 102 within a desired temperature range for a predetermined amount of time. However, according to some embodiments, after a long enough time period, once the inner PCM material has released as much heat as it can without changing phases, it may eventually succumb to the cooling influence of the outer PCM material and freeze (i.e., change phase). In some embodiments, a PCM material can maintain a substantially constant temperature at or around its phasing temperature while continuing to give off heat without changing phases for a very long time. For example, in some embodiments, an inner PCM material of the present disclosure can maintain a stable temperature range for up to 120 hours or more. According to some embodiments, if the inner PCM material changes phases (e.g., freezes), then it will no longer serve to stabilize the temperature of the container and the container may be likely to freeze under the influence of the cold outer PCM layer 110.

In some embodiments, if the outer PCM layer 110 does not have sufficient cooling potential (e.g., there is only a small amount of the outer PCM material compared to the amount of inner PCM material), the inner PCM material can withstand the outer PCM material's cooling effect by giving off heat but ultimately failing to change phase. In this case, once the outer PCM material's cooling potential has been exhausted (e.g., it has absorbed too much heat and has melted), it may no longer serve to cool the container or the inner PCM layer 104. As such, in this scenario, the container may be likely to begin to heat up once the cooling effect of the cooling PCM is exhausted. Thus, it should be understood that the desired temperature range can be achieved by selecting a PCM with an appropriate phasing temperature. Furthermore, the specified time period over which a passive temperature controlled container can maintain a stable temperature range can be determined by the amounts of the inner PCM material and outer PCM material. In some embodiments, the balance between the influence of the inner PCM material and the outer PCM material can be adjusted by changing the amount of PCM materials, the position of PCM materials, or the type of PCM material used.

According to some embodiments, an inner PCM layer may include an inner PCM material with a phasing temperature of 4° C. that can serve to maintain the temperature of the storage chamber at a desired temperature range of 2° C.-8° C. In some embodiments, an inner PCM may have a phasing temperature of between 2° C.-8° C. In some embodiments, an inner PCM may have a phasing temperature of between 15° C.-25° C. It should be understood that a wide variety of different PCM materials having different phasing temperatures can be used in both the inner PCM layer and the outer PCM layer to achieve a variety of desired temperature ranges. According to embodiments of the present disclosure, the desired temperature range of the storage chamber 102 can be adjusted by changing the type or amount of PCM material in the inner PCM layer 104 and/or outer PCM layer 110. For example, different desired temperature ranges may be achieved by removing or adding PCM containers (e.g., PCM sleeves or bottles) to the container or repositioning PCM containers within the container (e.g., by only placing a PCM sleeve or bottle in every other slot instead of every slot). Due to the modular nature of a passive temperature controlled container of the present disclosure, according to some embodiments, the container may be adjusted and reused to ship a multitude of different products having different temperature requirements. Furthermore, according to some embodiments, the amount and positioning (e.g., which slots they are placed in) of the inner PCM materials and outer PCM materials can influence convection currents in the air chamber layer 108, which can affect the uniformity of the temperature distribution within the container. Accordingly, a passive temperature controlled container of the present disclosure may be capable of achieving multiple levels of performance based on the particular configuration used. Furthermore, a passive temperature controlled container of the present disclosure may be reconfigured between usages to change the performance from one level to another, allowing a user to have a great deal of flexibility.

Figure 2A:
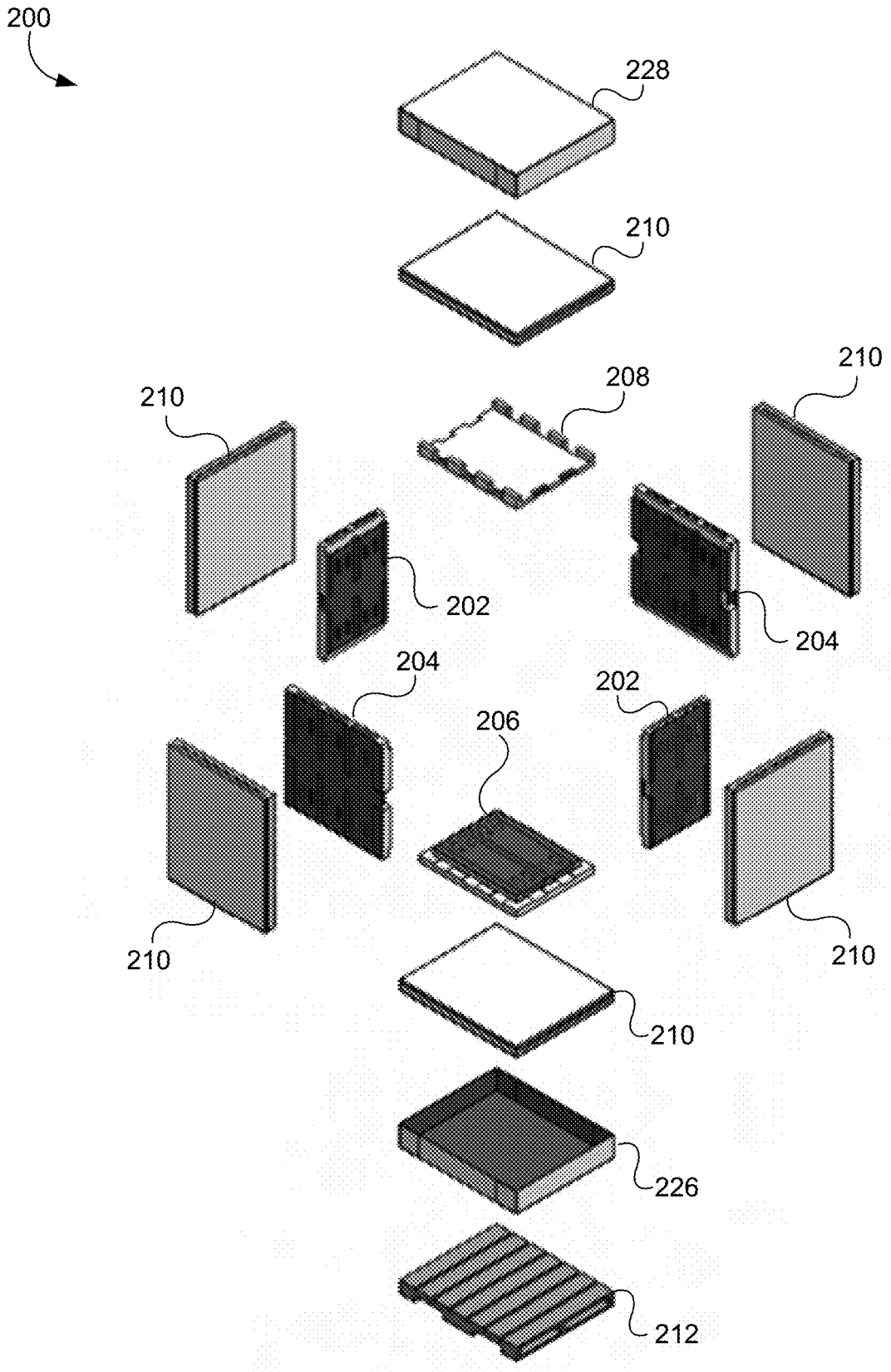
FIG. 2A is an exploded view of a passive temperature controlled container, in accordance with an example embodiment of the presently disclosed subject matter.

FIG. 2A illustrates an exploded view of an embodiment of a passive temperature controlled container 200 having six inner wall assemblies, including four side walls comprising two short side wall assemblies 202 and two long side wall assemblies 204, a base wall assembly 206, and a top wall assembly 208. The side wall assemblies 202, 204, base wall assembly 206, and top wall assembly 208 may be detachably attached together to form a storage chamber 102. It should be understood that the present disclosure contemplates that the wall assemblies may be designed to detachably attach without literally attaching to one another, by for example, having grooves, ridges, or contours that snuggly fit together. In some embodiments, the inner wall assemblies may be surrounded by one or more insulation wall assemblies 210. According to some embodiments, a plurality of insulation wall assemblies 210 may detachably attach together to form the exterior of the passive temperature controlled container 200. In some embodiments, a passive temperature controlled container 200 may further include a base lid 226 that may receive the bottom insulation wall assembly 210 and a lower portion of the side insulation wall assemblies 210, and a top lid 228 that may receive the top insulation wall assembly 210 and an upper portion of the side insulation wall assemblies 210. The base lid 226 and top lid 228 may provide structural stability to the passive temperature controlled container 200 by acting to reduce distortions to the container that may be caused by sheering forces. Additionally, in some embodiments, the side walls assemblies 202, 204, base wall assembly 206, top wall assembly 208, and/or insulation wall assemblies 210 may not attach to one another, but may rather fit together or be disposed adjacent to one another and thus may be secured together by the base lid 226 and top lid 228.

Figure 2C:
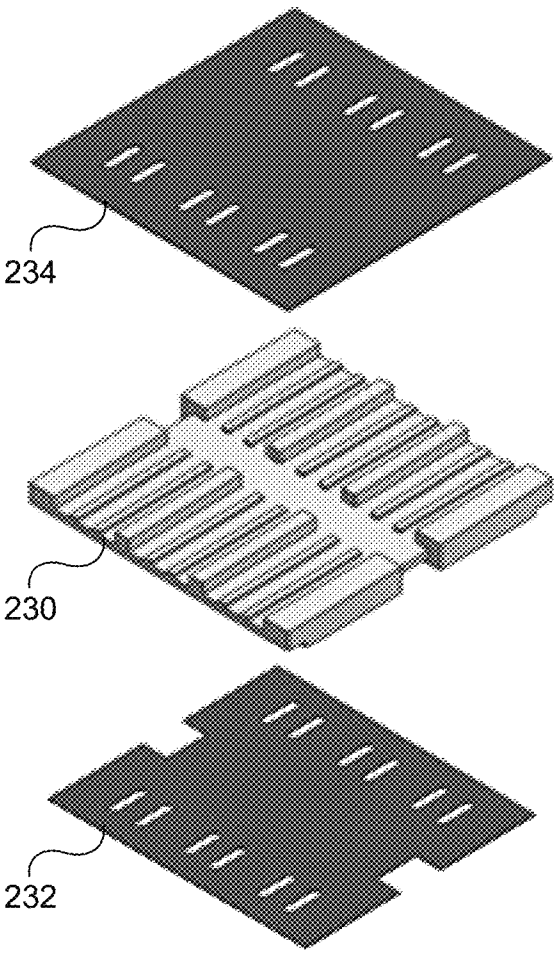
FIG. 2C is an exploded view of a long side wall assembly, in accordance with an example embodiment of the presently disclosed subject matter.
Figure 2B:
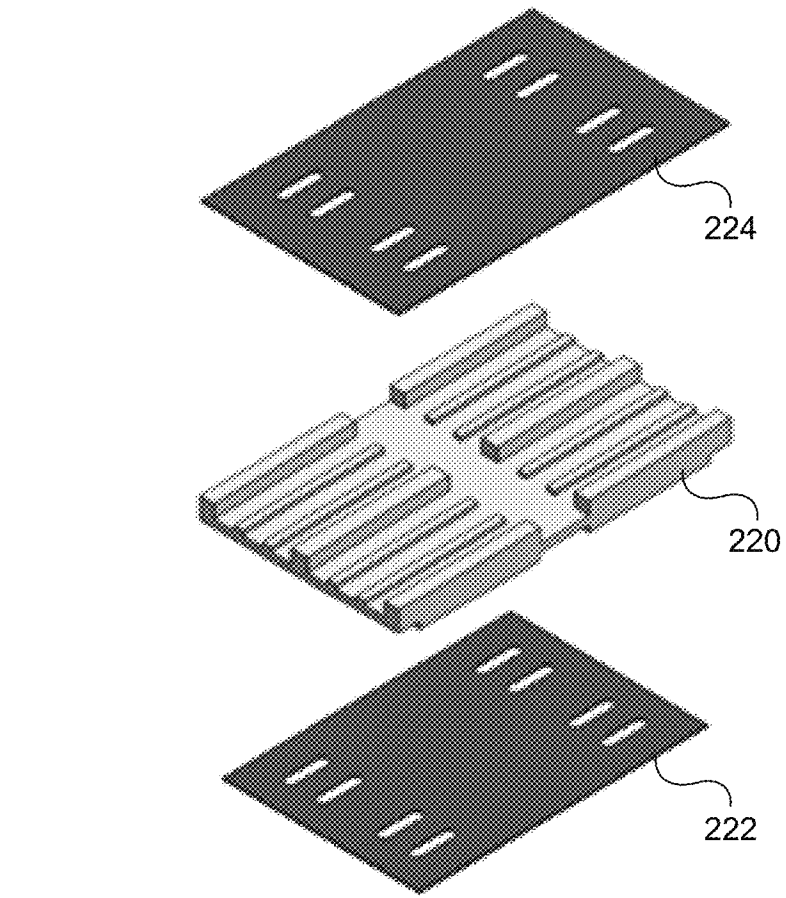
FIG. 2B is an exploded view of a short side wall assembly, in accordance with an example embodiment of the presently disclosed subject matter.

In some embodiments, as can be seen from the exploded views shown in FIGS. 2B-C, each side wall assembly 202, 204 may include a center piece 220, 230 having an inner face and an outer face, a front panel 222, 232 configured to cover the inner face, and a back panel 224, 234 configured to cover the outer face. The center piece 220, 230 may include a plurality of spacers and/or dividers that extend outwards from the surface of the center piece 220, 230. As shown in FIGS. 2B-C, a plurality of spacers and/or dividers can serve to create vertical and/or horizontal channels on the surface of the center piece 220, 230. A channel may be a recessed portion of the surface of a piece or panel that may be capable of receiving an object or providing a space for air to freely pass. According to some embodiments, when assembled, the side wall assemblies 202, 204 may be capable of receiving PCM containers (such as sleeves or bottles) in a space between the surface of a center piece 220, 230 and the respective panel 222, 224, 232, 234. For example, in some embodiments, a PCM container may be received by a short side wall assembly 202 between two dividers. The spacers that rise out of the surface of the center piece 220 may act to cause the PCM container to be positioned a distance away from the surface of the center piece 220, thereby creating an air channel that runs between the PCM container and the face of surface of the center piece 220. In some embodiments, this air channel may facilitate the movement of hot or cold air induced by the PCM materials present in the container. As described in further detail below with respect to FIG. 3, the various wall assemblies may be capable of receiving different PCM materials. For example, a first PCM material may be inserted into an inner slot or channel of a wall assembly, whereas a second PCM material may be inserted into an outer slot or channel of the wall assembly.

Figure 2E:
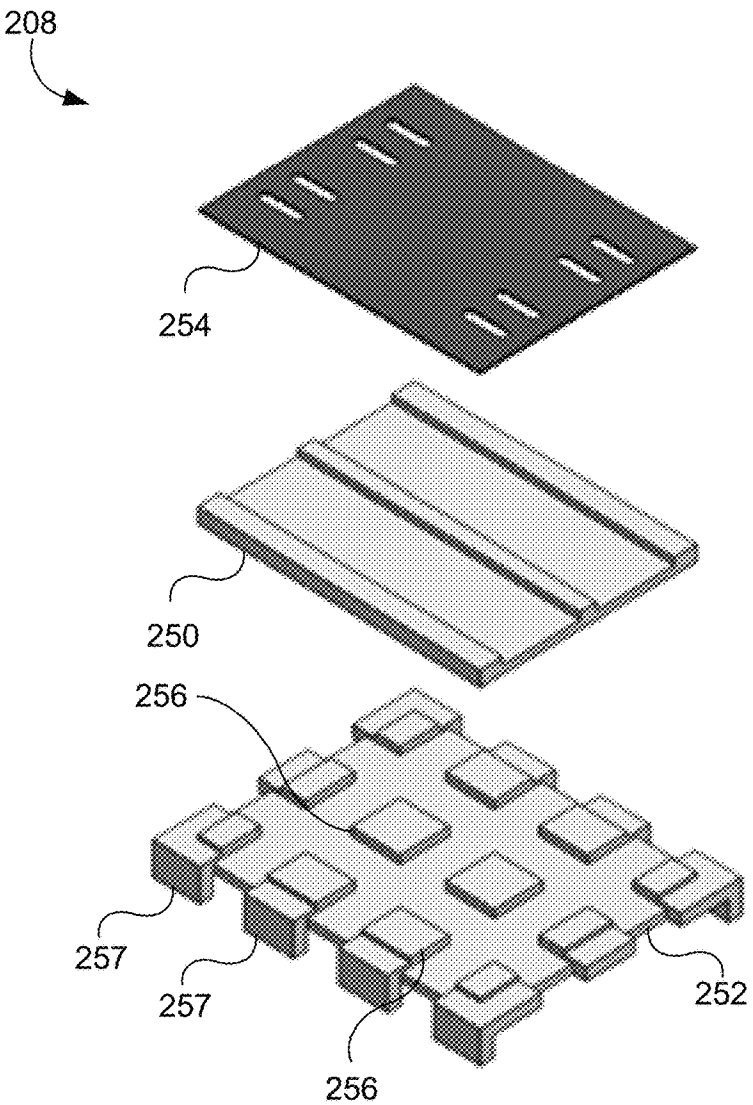
FIG. 2E is an exploded view of a top wall assembly, in accordance with an example embodiment of the presently disclosed subject matter.
Figure 2D:
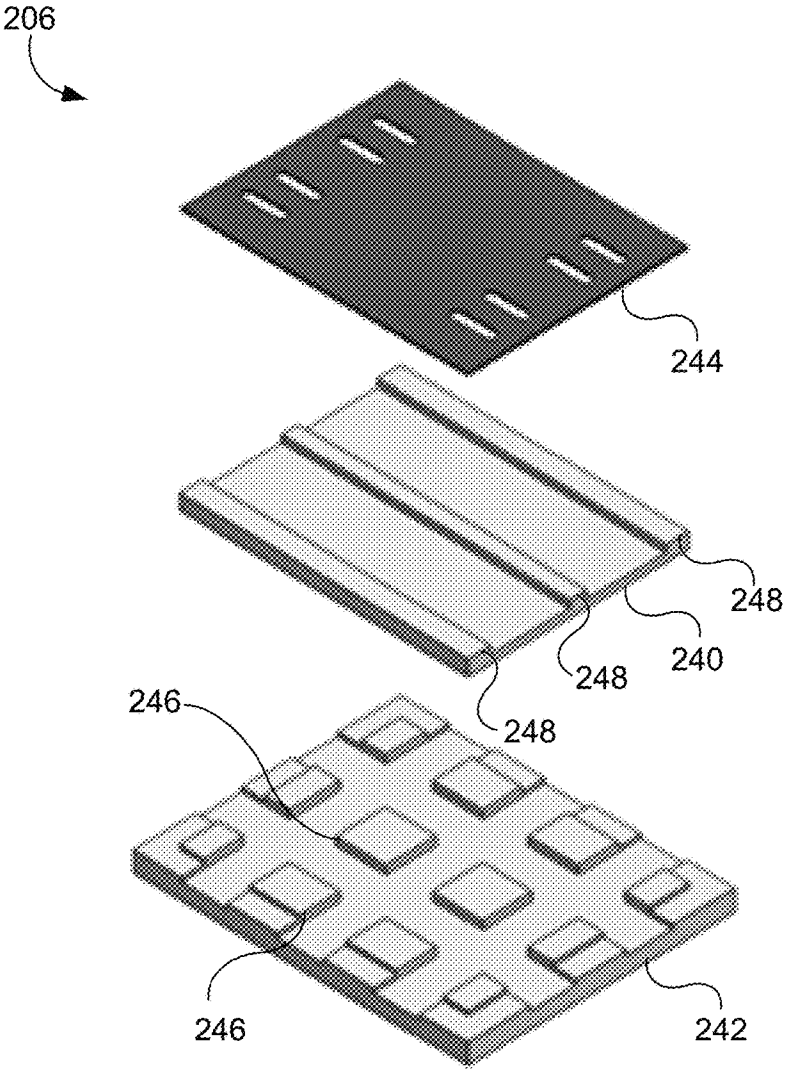
FIG. 2D is an exploded view of a base wall assembly, in accordance with an example embodiment of the presently disclosed subject matter.

As shown in FIG. 2D, in some embodiments, the base wall assembly 206 may include a base plate 242, a center piece 240, and a cover panel 244 that may be disposed on the top surface of the base wall assembly 206. According to some embodiments, the center piece 240 may be positioned between the base plate 242 and the cover panel 244. In some embodiments, the base plate 242 may include a plurality of spacer members 246 that may extend out of a surface of the base plate 242. In some embodiments, spacer members 246 may be generally rectangular-shaped and arranged in such a way to create one or more channels. In some embodiments, the channels formed by the spacer members 246 may form one or more rows that may run parallel to one another and/or perpendicular to one another. According to some embodiments, the center piece 240 may include one or more spacer members 248 that may form one or more channels, as shown in FIG. 2D.

As shown in FIG. 2E, in some embodiments, the top wall assembly 208 can have a tray portion 252, a center piece 250, and a cover panel 254 that is disposed on the bottom surface of top wall assembly 208. According to some embodiments, the center piece 250 may be positioned between the tray portion 252 and the cover panel 254. The tray portion 252 may include a plurality of spacer members 256 that extend out of a surface of the tray portion 242. In some embodiments, spacer members 256 may be generally rectangular-shaped and arranged in such a way to create one or more channels. In some embodiments, the channels formed by the spacer members 256 may form one or more rows that may run parallel to one another and/or perpendicular to one other. In some embodiments, the tray portion 252 may include one or more arm members 257 that extend away from the surface of the tray portion 252. The arm members 257 may be positioned around the outer edge of the tray portion 252 such that they may prevent an object placed on the surface of the tray portion 252 (e.g., a PCM sleeve or bottle) from sliding off of the tray portion 252. Furthermore, the arm members 257 may be spaced apart such that there is a gap between each adjacent pair of arm members 257 that may allow air to flow from an object placed on the surface of the tray portion 252 outwards from the tray portion 252.

According to some embodiments, the center piece 250 may include one or more spacer members 258 that may more form one or more channels, as shown in FIG. 2E.

In some embodiments, the panels 222, 224, 232, 234, 244, 254 described herein may be made of a corrugated material, such as corrugated fiberboard or plastic. Furthermore, one or more of these panels may include apertures or "finger slots" to allow a user to more easily allow for the removal of the PCM containers. Furthermore, in some embodiments, the length and/or width of the front panels 222, 232 and cover panels 244, 254 may be shorter than the length and width of the respective center pieces 220, 230, base plate 242, and tray portion 252 that they are associated with, which may create ridges that allow the wall assemblies to fit together. Furthermore, these ridges may provide space for air to flow from a side wall assembly 202, 204 to the base wall assembly 206 and/or the top wall assembly 208.

Figure 2F:
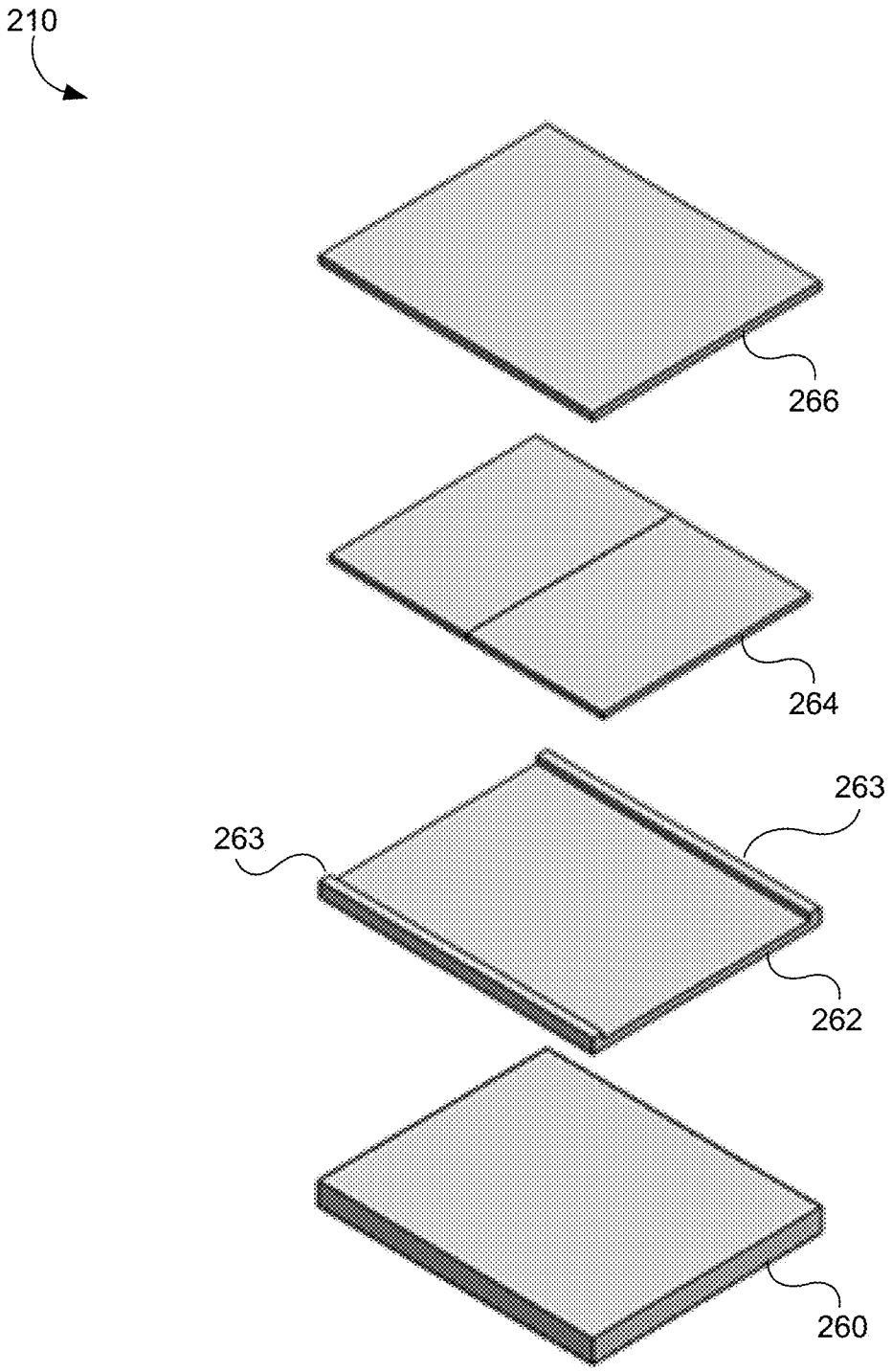
FIG. 2F is an exploded view of an insulation wall assembly, in accordance with an example embodiment of the presently disclosed subject matter.
Figure 2G:
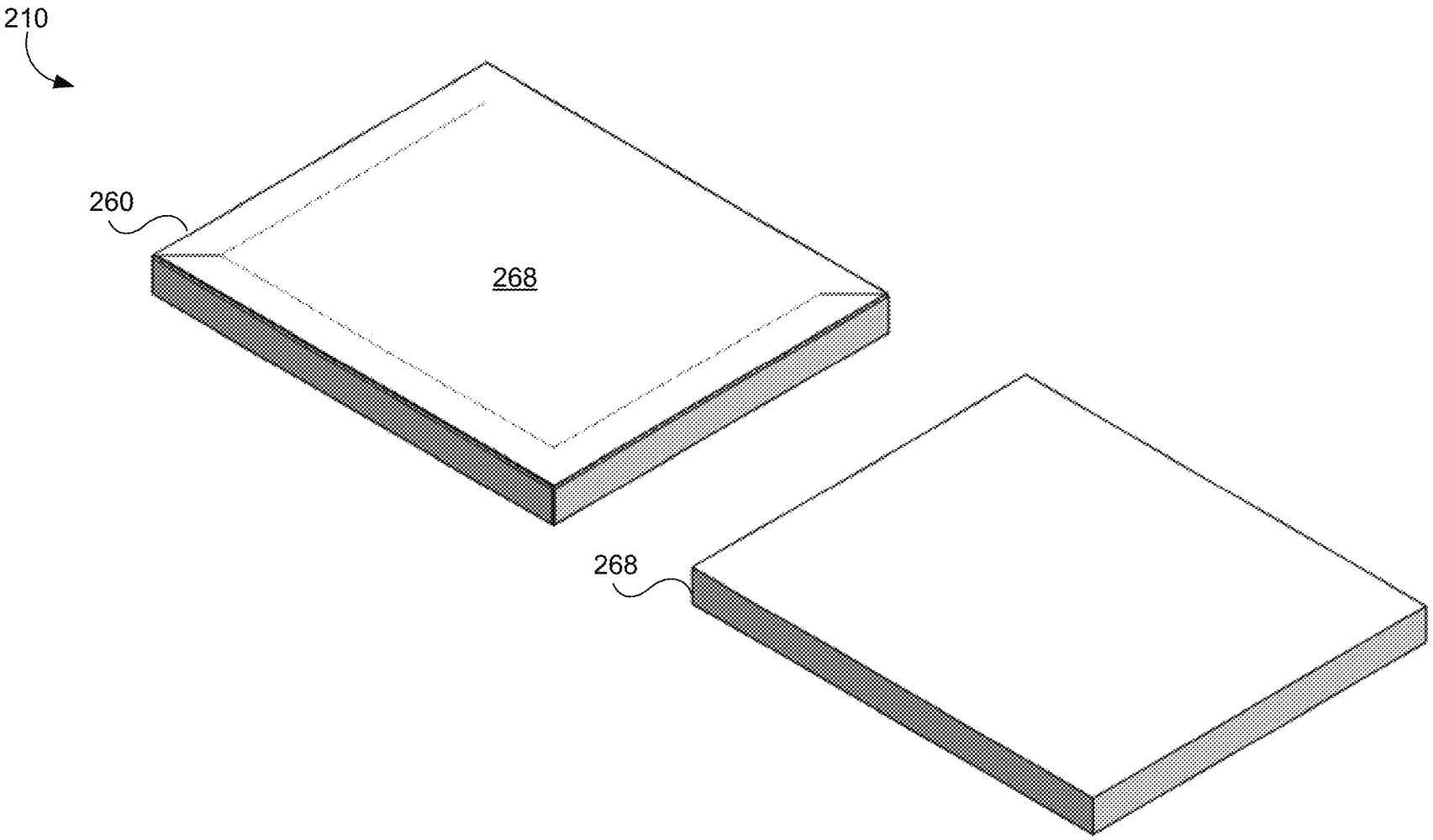
FIG. 2G is an exploded view of an insulation wall assembly, in accordance with an example embodiment of the presently disclosed subject matter.

As shown in FIG. 2F, according to some embodiments, an insulation side wall assembly may include an outer casing, a protective tray 262, one or more vacuum-insulated panels (VIPs) 264, and a protective cover 266. Use of VIPs 264 may provide insulation that may enhance the performance duration of the passive temperature controlled container 200. In some embodiments, the VIPs 264 may be approximately one-inch thick high insulation panels. According to some embodiments, the one or more VIPs 264 may be sandwiched between the protective tray 262 and the protective cover 266. The protective tray 262 may have one or more ridges 263 extending out of a surface of the protective tray 262, such that the protective tray 262 may snuggly receive the one or more VIPs 264. According to some embodiments, the protective tray 262 and protective cover 266 may be made of a material designed to protect the one or more VIPs from damage and to provide internal structure to the insulation wall assembly 210. For example, the protective tray 262 and protective cover 266 may be made out of foam or EPS. According to some embodiments, the protective tray, VIPs 264, and protective cover 266 may be inserted into the outer casing 260. In some embodiments, the outer casing 260 may have the shape of a rectangular tube with openings on one or two ends that may allow the protective tray 262, VIPs 264, and protective cover 266 to slide into the outer casing 260. As shown in FIG. 2G, in some embodiments, the insulation wall assembly 210 may include an outer casing 260 that is capable of removably housing one or more pieces of insulation material 268. In some embodiments, insulation material 268 may be, for example, a single block of EPS. Accordingly, an insulation wall assembly 210 of the present disclosure may include configurations including VIPs 264 and configurations without VIPs 264, to provide different levels of cost and results.

As can be seen from FIG. 2A, according to some embodiments, the side wall assemblies 202, 204, can be configured to fit together in a substantially rectangular configuration with the bottom of each side wall assembly 202, 204 configured to couple to the base wall assembly 206 and the top of each side wall assembly 202, 204 configured to couple to the top wall assembly 208, to substantially form a rectangular cuboid around the storage chamber 102. In some embodiments, a side wall assembly 202, 204 the base wall assembly 206, and/or the top wall assembly 208 may include one or more slots and/or grooves that can receive a portion of a neighboring wall assembly to allow neighboring wall assemblies to removably attach to one another.

According to some embodiments, the interior walls of the storage chamber 102 may be made up of the front panels 222, 232 of each side wall assembly 202, 204 as well as the cover panel 244 of the base wall assembly 206 and the cover panel 254 of the top wall assembly 208. In some embodiments, the payload 310 of the storage chamber 102 may be prevented from coming into contact with any PCM materials. Furthermore, in some embodiments, because the weight of the top wall assembly 208 is fully supported by the base wall assembly 206 and side wall assemblies 202, 204, the payload 310 may sit in the storage chamber 102 without supporting any load. In some embodiments the assembled inner wall assemblies 202, 204, 206, 208 may be surrounded by a plurality of insulation walls assemblies 210. In some embodiments, there may be six insulation wall assemblies 210 that can form a rectangular cuboid around the inner wall assemblies (i.e., the short side wall assemblies 202, long side wall assemblies 204, base wall assembly 206, and top wall assembly 208). According to some embodiments, each insulation wall assembly 210 may form the exterior of the passive temperature controlled container 200 and provide a layer of insulation and protection to the container. The passive temperature controlled container 200 can be designed to be carried by a shipping pallet 212.

According to some embodiments, the side wall assemblies 202, 204, the base wall assembly 206, and the top wall assembly 208 may be configured to receive or hold one or more PCM sleeves, PCM bottles, or any other suitable packaging containing a PCM material. Although this disclosure primarily refers to "PCM sleeves," it will be understood that this term may include PCM bottles or any other such suitable packaging. According to some embodiments, a PCM sleeve can be a refrigerant sleeve containing a PCM material. In some embodiments, a PCM sleeve may be a sealed, flexible enclosure containing a PCM material within it. In some embodiments, a PCM bottle may be a bottle containing a PCM material. PCM bottles may be made of glass, plastic, or any other such suitable material. PCM materials or refrigerants may include frozen water, dry ice, VIP (vacuum insulated panels), or any other PCM material that is known in the art. In some embodiments, a PCM container of the present disclosure may be designed to fit snuggly into a slot of one or more inner wall assemblies.

Figure 3:
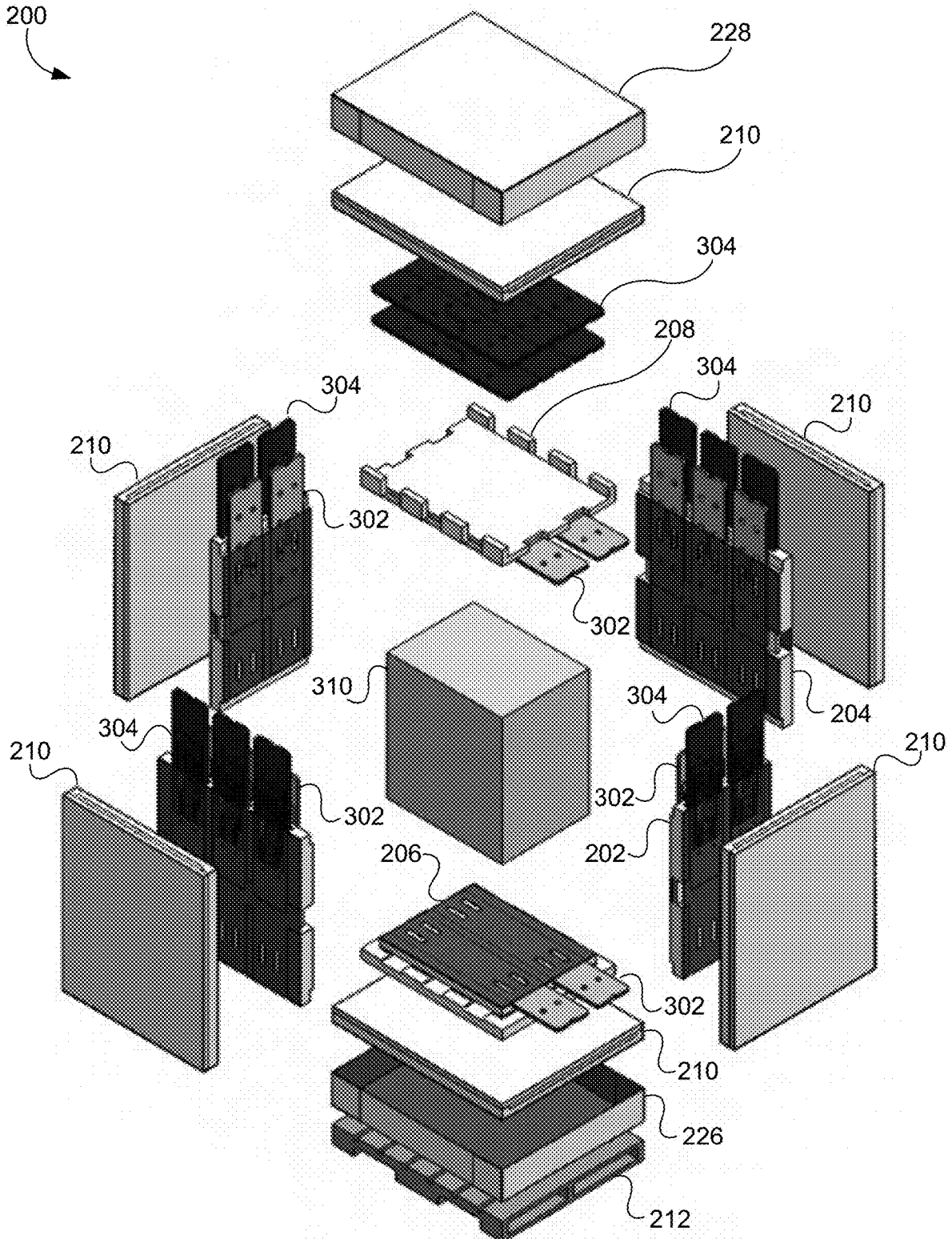
FIG. 3 is an exploded view of a passive temperature controlled container, in accordance with an example embodiment of the presently disclosed subject matter.

As shown in FIG. 3, in some embodiments, a short side wall assembly 202 can include one or more slots that can receive inner PCM sleeves 302 and outer PCM sleeves 304. For example, a short side wall assembly 202 may have one or more front slots disposed between the center piece 220 and the front panel 222. Furthermore, the short side wall assembly 202 may have one or more back slots disposed between the center piece 220 and the back panel 224. Similarly, a long side wall assembly 204 may include one or more front and/or back slots that may receive PCM sleeves 302 and/or outer PCM sleeves 304. According to some embodiments of the present disclosure, the base wall assembly 206 may include one or more slots that can receive one or more inner PCM sleeves 302. According to some embodiments, the one or more slots of the base wall assembly 206 may be disposed between the center piece 240 and the cover panel 244. According to some embodiments, the top wall assembly 208 may include one or more slots that can receive inner PCM sleeves 302. In some embodiments, the or more slots of the top wall assembly 208 may be disposed between the center piece 250 and the cover panel 254. In some embodiments, the top wall assembly 208 may further include a tray portion 252 that may hold one or more outer PCM sleeves 304, as shown in FIG. 3. It should be understood that although the example shown in FIG. 3 depicts the side wall assemblies 202, 204, base wall assembly 206 and top wall assembly 208 each receiving a particular number of inner PCM sleeves 302 and outer PCM sleeves 304, the embodiment shown in FIG. 3 is merely illustrative and the inner wall assemblies of a passive temperature controlled container 200 may include slots configured to receive any number of inner PCM sleeves 302 and/or outer PCM sleeves 304.

According to some embodiments, the inner PCM sleeves 302 can make up the inner PCM layer 104 and the outer PCM sleeves 304 can comprise the outer PCM layer 110 of the conceptual view shown in FIG. 1. Furthermore, in some embodiments the portions of the inner wall assemblies containing slots (e.g., the center pieces 220, 230 of the side wall assemblies 202, 204) may make up the buffer layer 106 of the conceptual view shown in FIG. 1. The buffer layer 106, which can include the center pieces 220, 230 of the side walls 202, 204, the center piece 250 of the top wall assembly 208, and a center piece 240 of the base wall assembly 206, can be made from a material with a high insulation value, such as, for example, Neopor, Expanded Polystyrene (EPS) foam, or any other such suitable material. In some embodiments, the buffer layer 106 may prevent the inner PCM sleeves 302 from coming into contact with the outer PCM sleeves 304 thereby inhibiting any heat transfer from occurring by contact. Furthermore, in some embodiments, channels present in the buffer layer 106 (e.g., an air cavity disposed between the surface of a center piece 220 and outer PCM sleeve 304 that has been inserted into a long side wall assembly 204) can serve to create the air chamber layer 108 of the conceptual view shown in FIG. 1.

Figure 4:
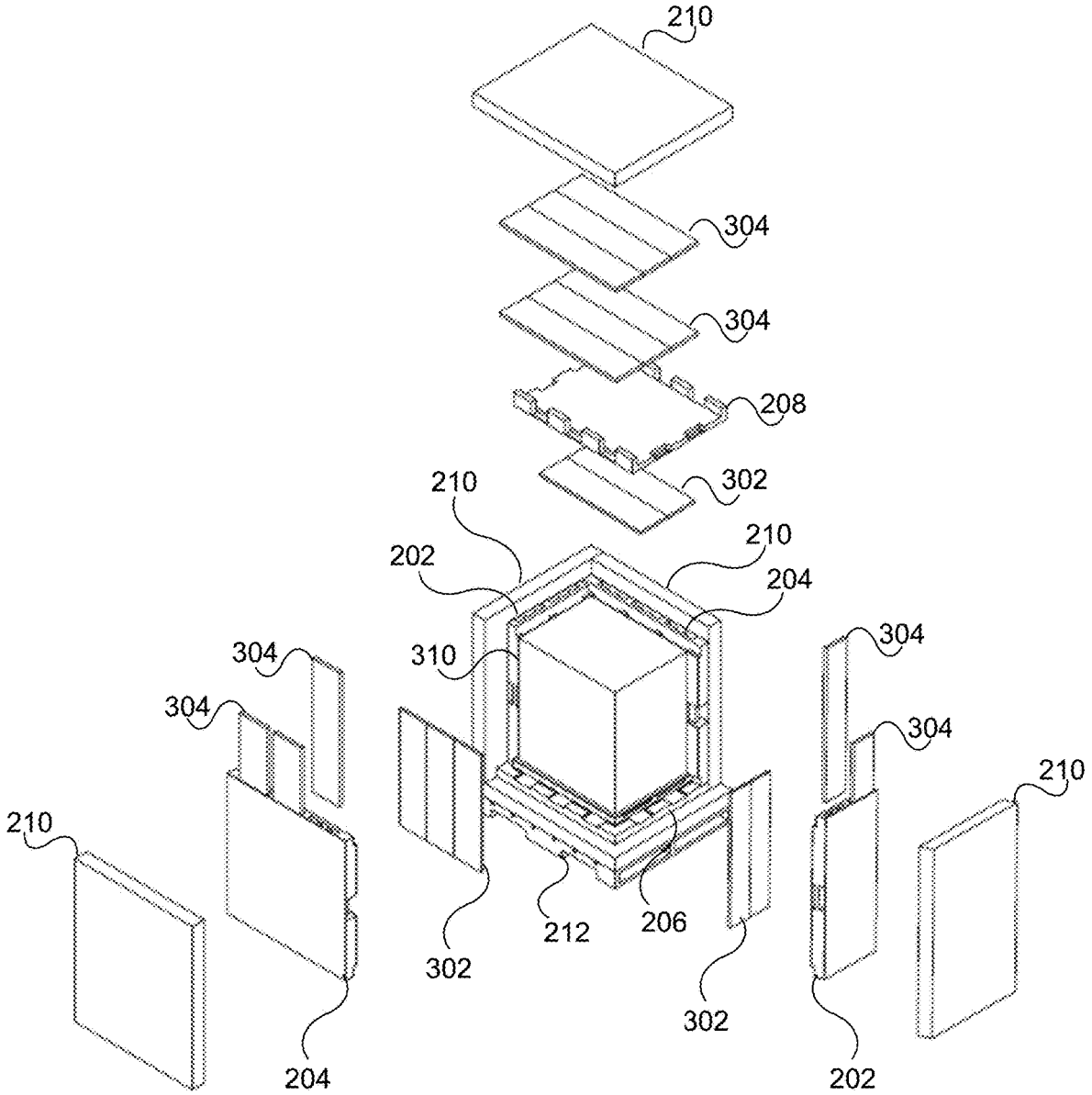
FIG. 4 is an exploded view of a passive temperature controlled container, in accordance with an example embodiment of the presently disclosed subject matter.

FIG. 4 illustrates a partially exploded view of a passive temperature controlled container 200. FIG. 4 shows the configuration of the inner wall assemblies 202, 204, 206, 208 and insulation wall assemblies 210 when the passive temperature controlled container 200 is partially assembled, according to an example embodiment.

Figure 5:
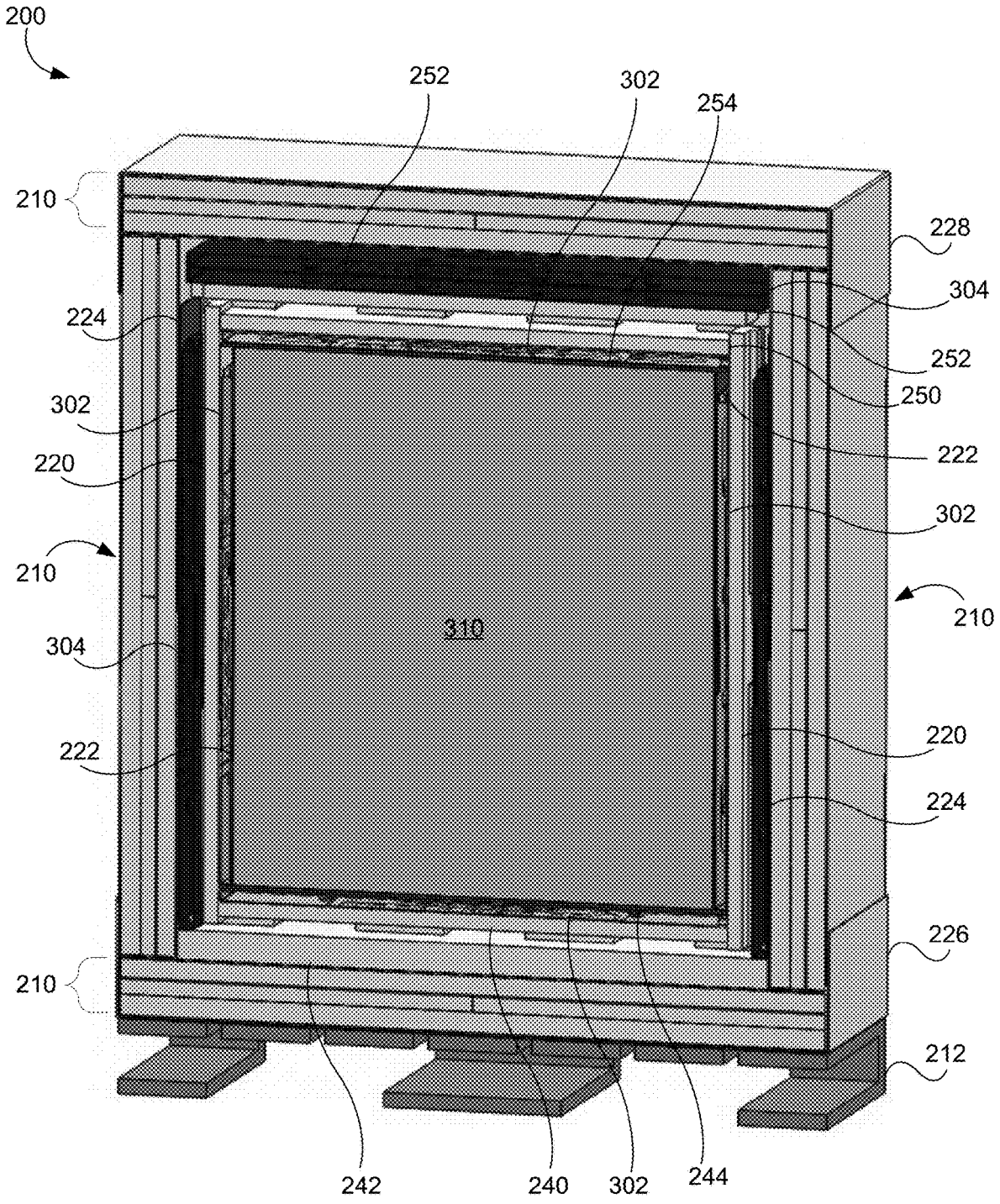
FIG. 5 is a cross-sectional perspective view of a passive temperature controlled container, in accordance with an example embodiment of the presently disclosed subject matter.

FIG. 5 illustrates a front cross-sectional view of a passive temperature controlled container, in accordance with an example embodiment. According to some embodiments, as shown in FIG. 5, an assembled passive temperature controlled container 200 may include a first PCM layer including one or more inner PCM sleeves 302 separated by a buffer (e.g., center pieces 220, 230, and 250) from a second PCM layer including one or more outer PCM sleeves 304. As described in greater detail below with respect to FIGS. 6-11, the passive temperature controlled container 200 may further include air channels that allow a thermal transfer to occur between the first PCM layer and second PCM layer via the movement of air through the air channels.

Figure 6:
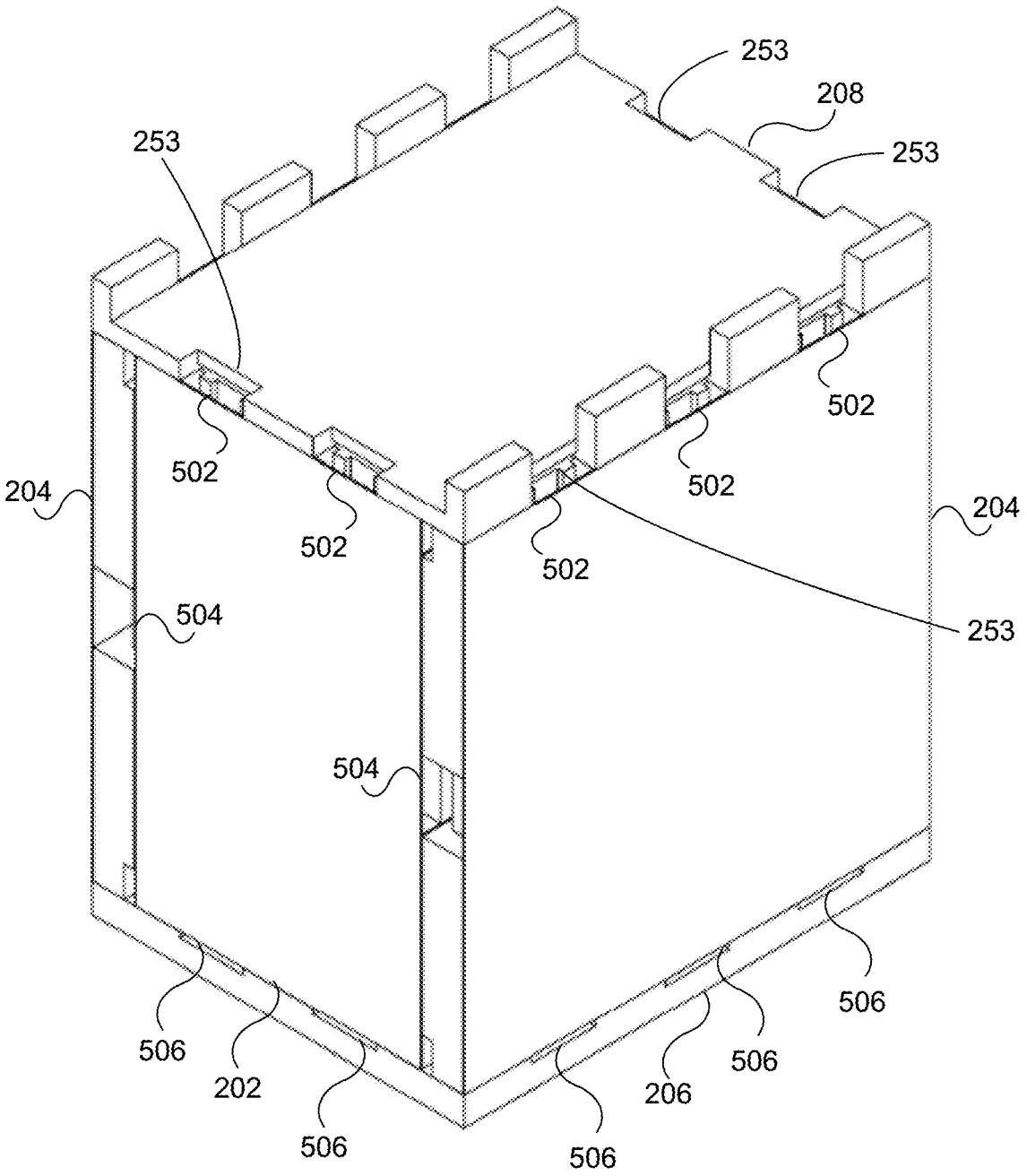
FIG. 6 is a perspective view of an assembled passive temperature controlled container without the outer insulation walls, in accordance with an example embodiment of the presently disclosed subject matter.

FIG. 6 illustrates the fully assembled inner wall assemblies 202, 204, 206, 208 of a passive temperature controlled container 200 in accordance with an example embodiment of the present disclosure. In some embodiments, the assembled inner wall assemblies may include a plurality of vertical channels 502, horizontal channels 504, and/or base channels 506 that may make up part of the air chamber layer 108 of FIG. 1. As shown in FIG. 6, in some embodiments, the top wall assembly 208 can include a plurality of recessed portions 253 around the perimeter of the tray portion 252. These recessed portions 253 may align with vertical channels 502 of the side wall assemblies thereby allowing air to flow from the top wall assembly 208 of the passive temperature controlled container 200, through the side wall assemblies 202, 204, and down to the base wall assembly 206. In some embodiments, outer PCM sleeves 304 may be placed on the top surface of the tray portion 252. Accordingly, in some embodiments, via convection through the vertical channels 502, the outer PCM sleeves 304 may impact the temperature of the inner PCM sleeves 302. Furthermore, according to some embodiments, there may be a space between the top of the outer PCM sleeves 304 placed on the top surface of the tray portion 252 and the inner surface of an insulation wall assembly 210 positioned above the top wall assembly 208, such that air may flow across the top of the outer PCM sleeves 304 placed in the tray portion 252. According to some embodiments, as shown in FIG. 6, the assembled passive temperature controlled container 200 may include horizontal channels 504 that link each side wall assembly to the adjacent side wall assemblies such that one continuous horizontal channel 504 runs around all of the side wall assemblies 202, 204. According to some embodiments, the horizontal channels 504 can allow air to flow around the side wall assemblies 202, 204.

In some embodiments, the vertical channels 502 of a given side wall assembly may be connected to the horizontal channel 504 of the side wall assembly, such that air may flow both vertically and horizontally within a side wall assembly. FIG. 6 shows base channels 506 that may be present in the base wall assembly 206. For example, base channels 506 may be formed by the space between the base plate 242 and the center piece 250. According to some embodiments, the base channels 506 may allow air to flow within the base wall 206 in a cross-hatch pattern, with each vertical channel of the side walls 202, 204 connecting with an opening to a base channel 506. Thus, according to some embodiments, air can flow around all six sides of the passive temperature controlled container 200 because air may move from the space above the outer PCM sleeves 304 in the tray portion 252 of the top wall assembly 208 to the vertical channels 502, horizontal channels 504, and base channels 506 of the passive temperature controlled container 200.

Figure 7:
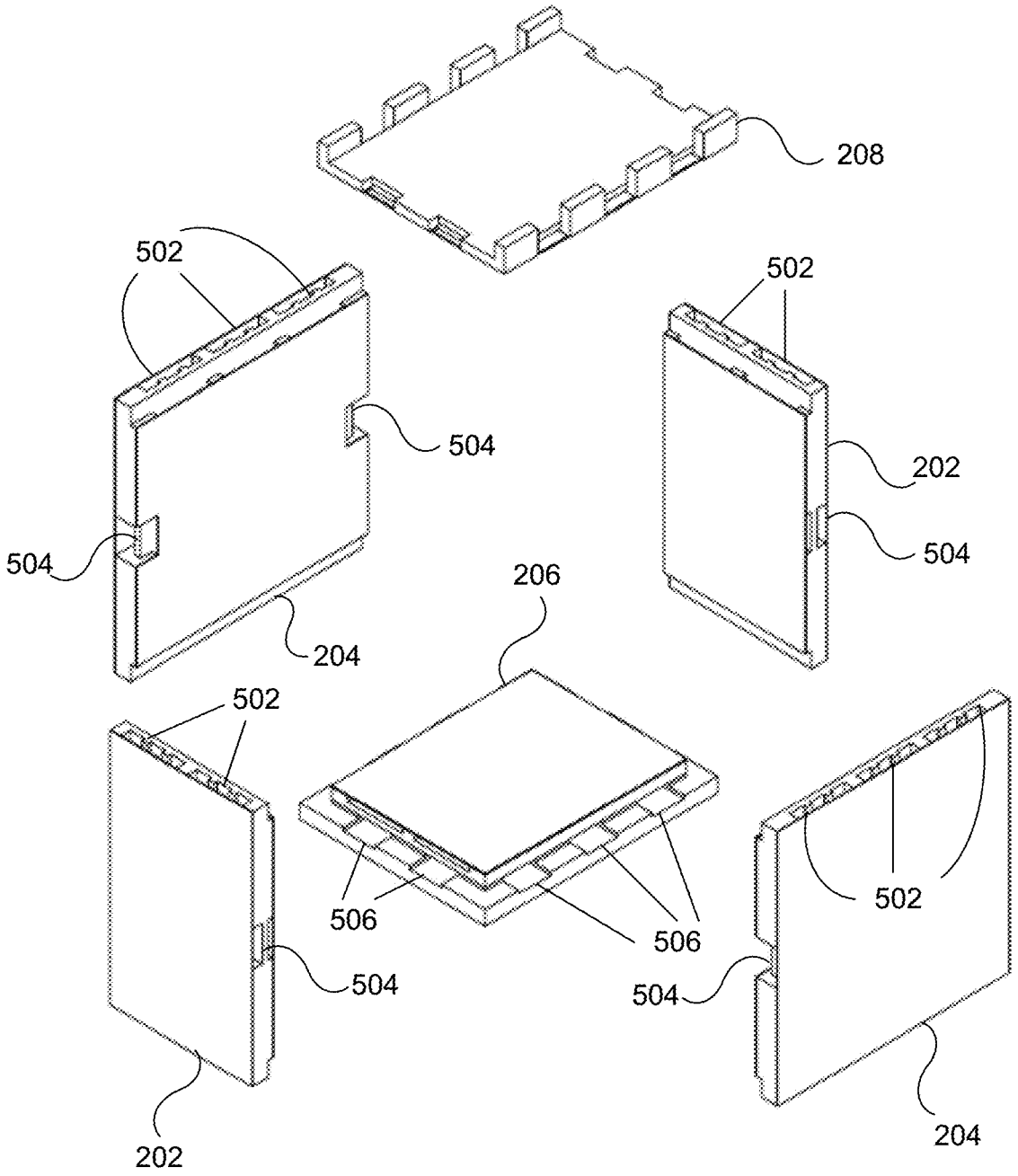
FIG. 7 is an exploded view of the passive temperature controlled container of FIG. 5, in accordance with an example embodiment of the presently disclosed subject matter.

FIG. 7 shows an exploded view of the inner walls shown assembled in FIG. 6. In this view, the vertical channels 502 of each side wall assembly 202, 204 are shown. Furthermore, FIG. 7 illustrates how the horizontal channels 504 of the side wall assemblies align to allow air to flow around the entire perimeter of the side wall assemblies.

Figure 8:
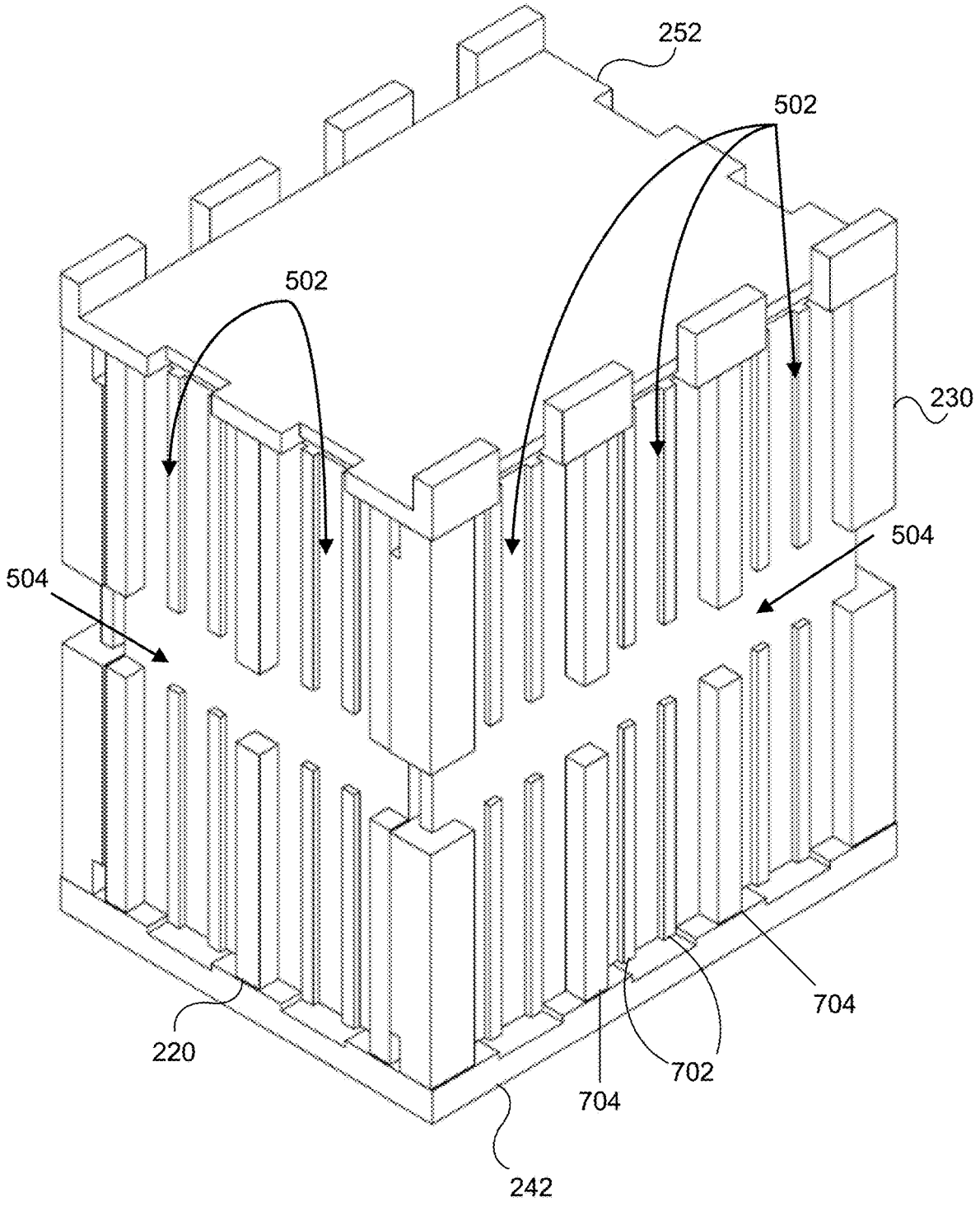
FIG. 8 is a perspective view of the passive temperature controlled container of FIG. 5 with the back panels removed, in accordance with an example embodiment of the presently disclosed subject matter.

FIG. 8 shows the assembled wall assemblies of FIG. 6, but with the back panels 224, 234 of the side wall assemblies 202, 204 removed. FIG. 8 shows how the vertical channels 502 and horizontal channels 504 are formed. As shown, each center piece 220, 230 of the side wall assemblies 202, 204 includes a number of vertical spacers 702 that extend outwards from the outer face of the center piece. According to some embodiments, the vertical spacers may be positioned between two vertical dividers 704 that also extend outwards from the outer face of the respective center piece. According to some embodiments, a vertical divider 704 may extend outwards from the outer face of a center piece 220, 230 to a distance greater than a vertical spacer 702 extends. When a back panel 224, 234 is placed against the outer face of center piece 220, 230, a vertical chamber can be formed between the outer face of the center piece 220, 230 and the back panel 224, 234. According to some embodiments, a vertical chamber can include an outer slot for receiving an outer PCM sleeve 304 and a vertical channel 502 for allowing air to flow vertically across a surface of the side wall assembly. In some embodiments, an outer slot may be disposed between two vertical dividers 704 and may be formed in the space between the surface of a back panel 224, 234 and the outer surface of one or more vertical spacers 702. In some embodiments, a vertical channel 502 can be formed between the outer face of a center piece 220, 230 and the adjacent face of an outer PCM sleeve 304 that has been inserted into the outer slot. Thus, one or more vertical channels 502 may be formed in the spaces between the vertical spacers 702 and the spaces between a vertical spacer 702 and a vertical divider 704. As shown in FIG. 8, horizontal channels 504 can be formed by a gap in the vertical spacers 702 and the vertical dividers 704 that extend outwards from the outer face of the center pieces 220, 230 of the side wall assemblies. The horizontal channels 504 may be bounded by the back panels 224, 234 when the passive temperature controlled container 200 is assembled.

Figure 9:
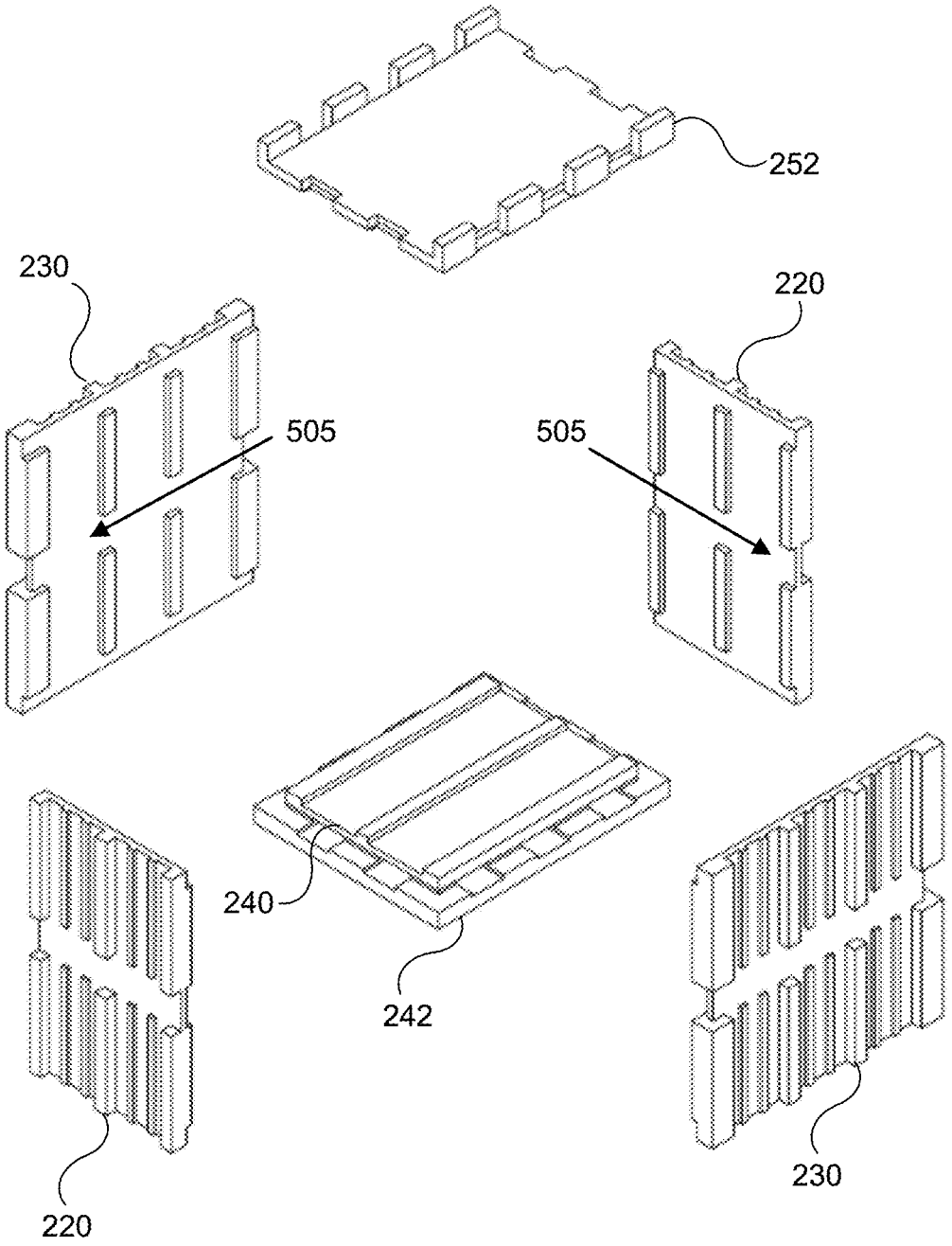
FIG. 9 is an exploded view of the passive temperature controlled container of FIG. 7, in accordance with an example embodiment of the presently disclosed subject matter.

FIG. 9 shows an exploded view of the center pieces shown assembled in FIG. 8. In this view it can be seen that the front panels 222, 232 of the side wall assemblies 202, 204 have been removed, as well as the cover panel 244 of the base wall assembly 206. As shown, according to some embodiments, the inner face of each center piece 220, 230 of the side wall assemblies 202, 204 may include vertical dividers similar to the outer face of each center piece 220, 230 of the side wall assemblies 202, 204. In some embodiments, an inner slot can be formed between the inner face of a center piece 220, 230 of a side wall assembly 202, 204, the corresponding front panel 222, 232 used to cover the inner face, and two vertical dividers extending away from the inner face of the center piece 220, 230 of the side wall assembly as shown in FIG. 9. According to some embodiments, an inner slot can be configured to receive an inner PCM sleeve 302. As shown in FIG. 9, in some embodiments, the vertical dividers on the inner face of each center piece 220, 230 of each side wall assembly 202, 204 may include a gap in the middle to form an internal horizontal channel 505. Thus, according to some embodiments, the side wall assemblies 202, 204 can have an outer horizontal channel 504 that can interact with the outer PCM sleeve 304 and an inner horizontal channel 505 that can interact with the inner PCM sleeve 302. As those of skill in the art will appreciate, heat transfers may occur between the inner PCM sleeves 302 and outer PCM sleeves 304 through the air moving via the various vertical and horizontal channels described herein.

Figure 11:
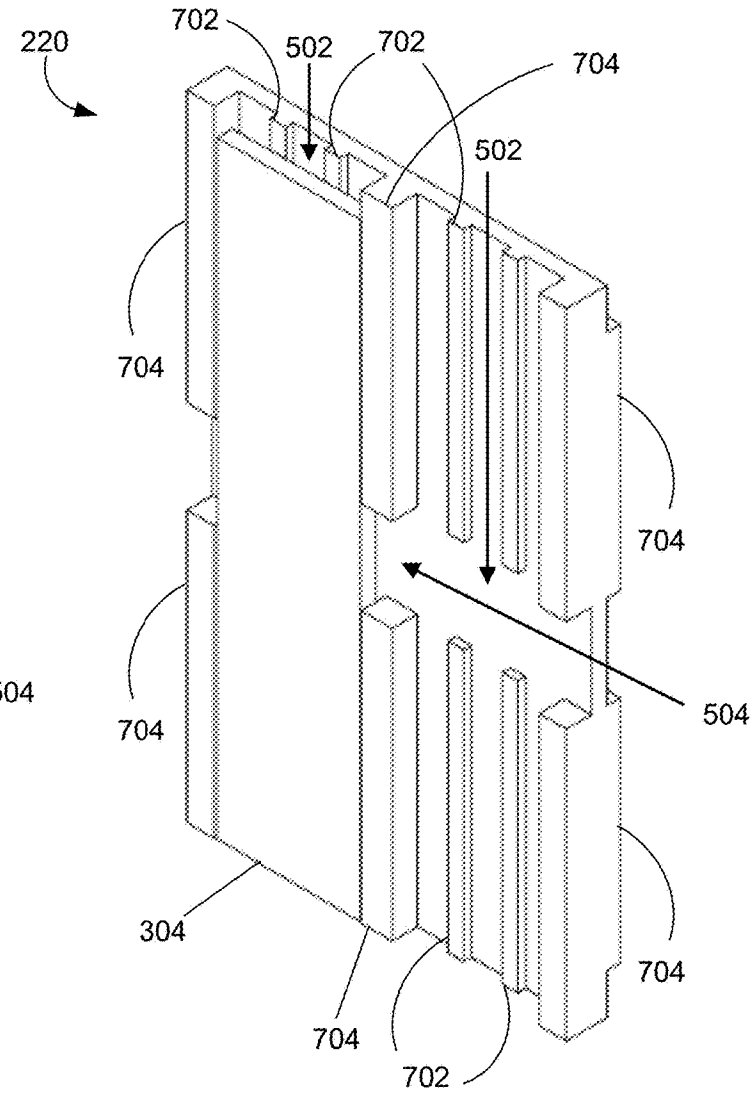
FIG. 11 is an perspective view of the short side wall of FIG. 10, showing an outer PCM sleeve placed in a vertical slot in accordance with an example embodiment of the presently disclosed subject matter.
Figure 10:
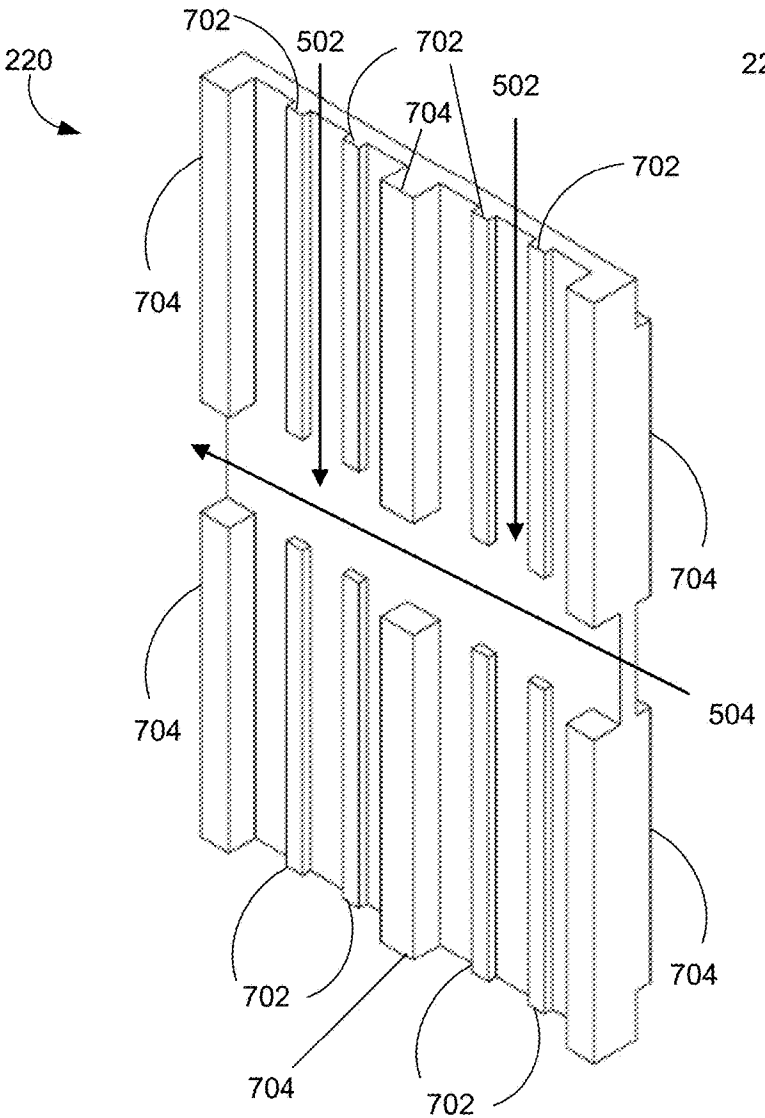
FIG. 10 is an perspective view of a short side wall of the passive temperature controlled container of FIG. 9, in accordance with an example embodiment of the presently disclosed subject matter.

FIG. 10 shows perspective view of a short side wall assembly 202 of the passive temperature controlled container 200 of FIG. 9. FIG. 11 shows the short side wall assembly 202 of FIG. 10 with an outer PCM sleeve 304 placed in a slot of a vertical chamber of the side wall assembly 202. As can be seen by comparing FIGS. 10 and 11, when an outer PCM sleeve 304 is placed into a slot of the side wall assembly 202, a vertical chamber 502 that can allow air to flow vertically down the side wall assembly 202 is formed between a face of the outer PCM sleeve 304 and the outer face of the center piece 220 of the short side wall assembly 202. Likewise, according to some embodiments of the present disclose, the horizontal channel 504 may run horizontally underneath the outer PCM sleeve 304 and the horizontal channel 504 can allow air to flow horizontally across the short side wall assembly 202. It should be understood that these are illustrative examples and that the inner wall assemblies (i.e., the side wall assemblies 202, 204, base wall assembly 206, and top wall assembly 208) may be configured in different configurations and arrangements of inner PCM sleeves 302, outer PCM sleeves 304, vertical channels 502, horizontal channels 504, and base channels 506.

Figure 12:
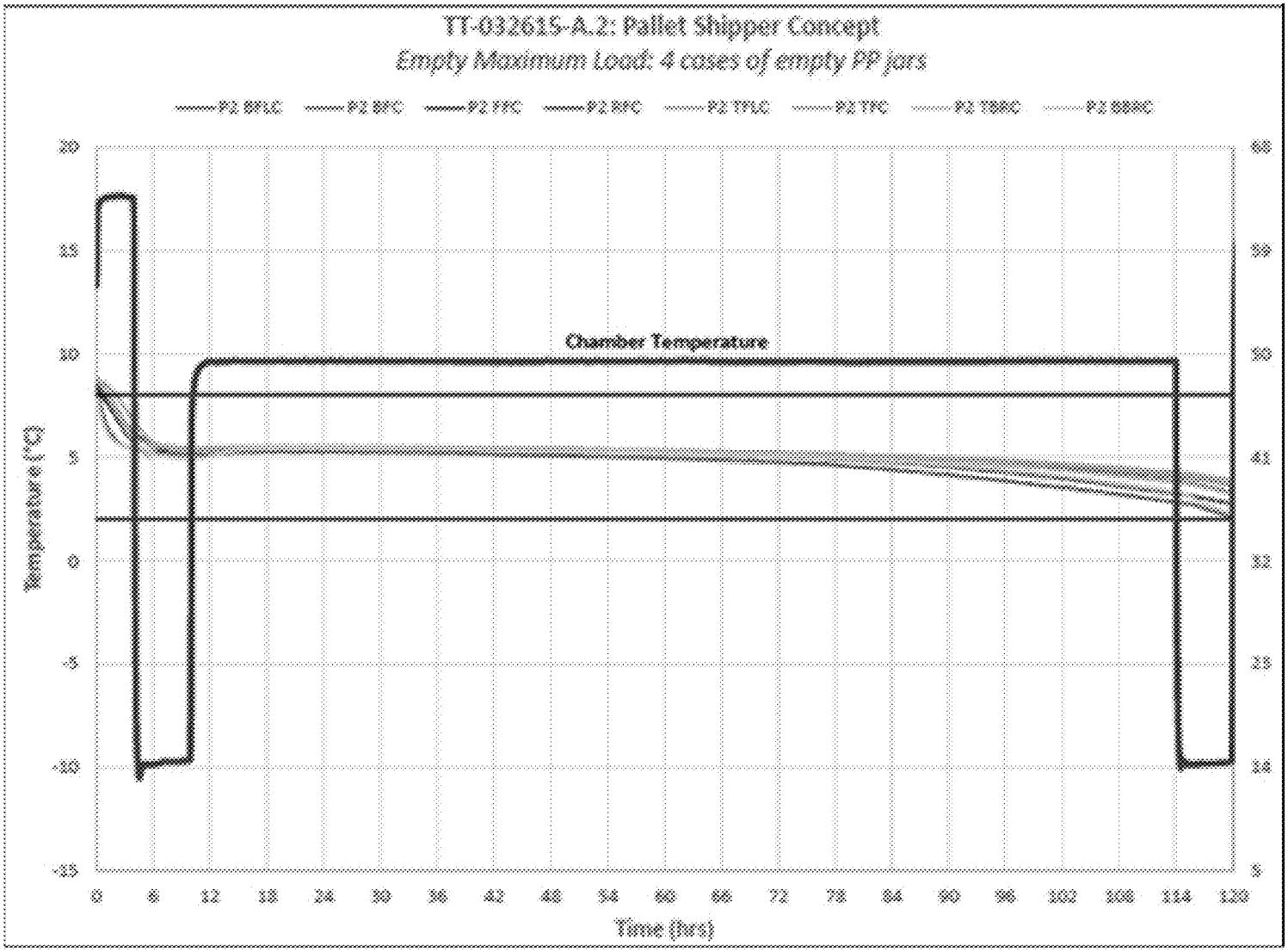
FIG. 12 is a chart depicting the performance of a passive temperature controlled container, in accordance with an example embodiment of the presently disclosed subject matter.
Figure 13:
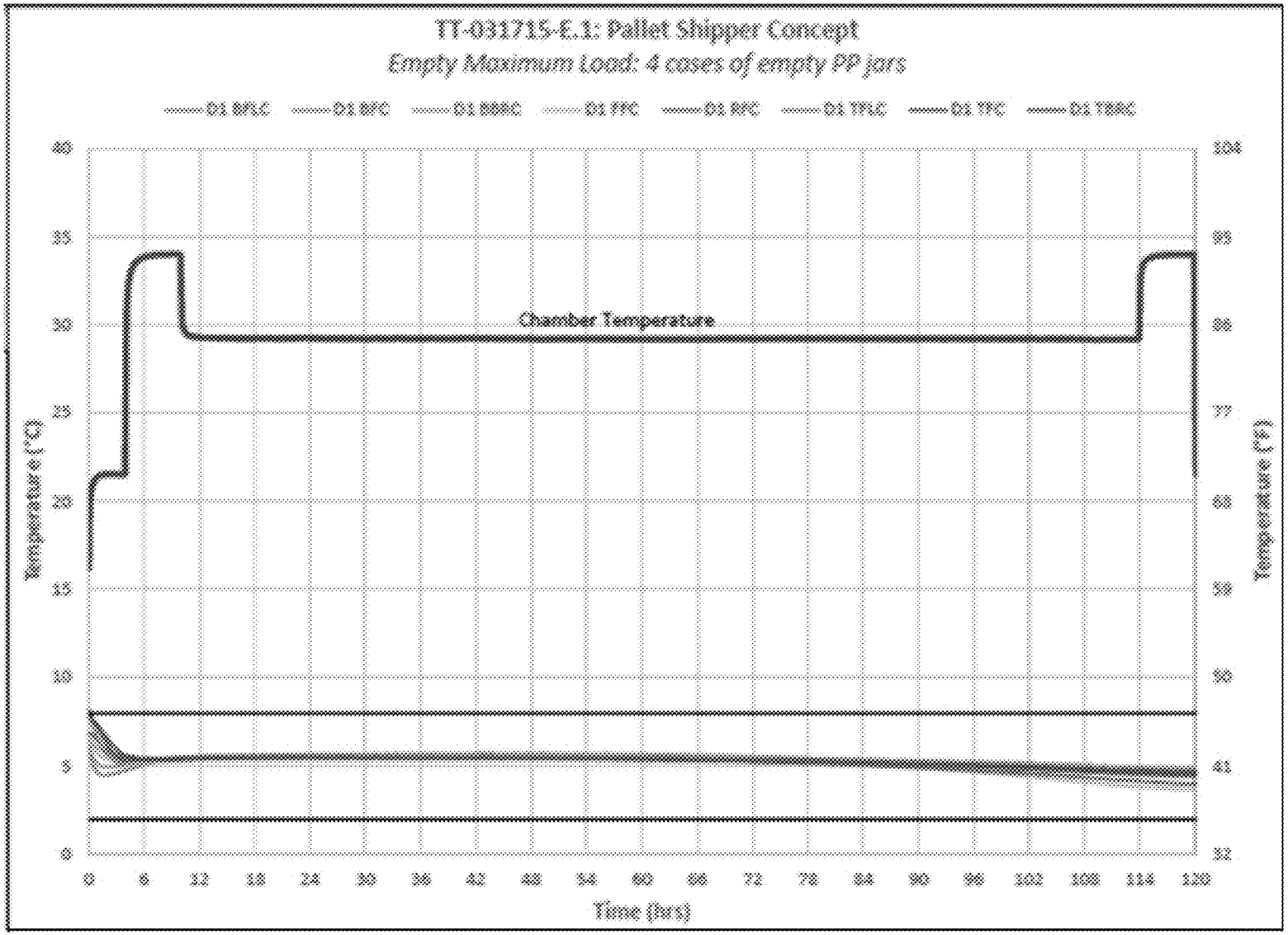
FIG. 13 is a chart depicting the performance of a passive temperature controlled container, in accordance with an example embodiment of the presently disclosed subject matter.

FIGS. 12-13 each show a chart depicting the performance of a passive temperature controlled container 200 placed within a temperature-controlled experimental chamber to simulate the effects of transport through different environments, in accordance with example embodiments of the present disclosure. As shown in the example in FIG. 12, the temperature of the cargo begins at slightly above 8° C. and quickly drops to around 5° C. In some embodiments, this initial drop in temperature can be caused by the cooling effect of the outer PCM layer 110. In this example, the inner PCM material has a phasing temperature of 5° C. which serves to stabilize the storage chamber temperature between 2° C.-8° C. for 120 hours, despite the experimental chamber temperature being swung between a range of roughly −10° C. to 18° C. As previously discussed, the duration over which the inner PCM material is able to emit heat without changing phase (thereby maintaining a stable temperature range) can be determined by the relative amounts and positioning of the inner PCM material compared to the outer PCM material. As can be seen from the graph, the influence of the cold outer PCM layer 110 eventually overcomes the stabilizing effect of the inner PCM layer 104 and the cargo temperature drops below the desired range somewhere beyond 120 hours. FIG. 13 shows a similar experiment, but simulates transport through a hot environment, with temperatures in excess of 30° C. As shown in FIG. 13, the passive temperature controlled container 200 can be effective in maintaining a cargo temperature within the range of 2° C. to 8° C. for 120 hours (or more) in hot conditions. Thus, the passive temperature controlled container 200 of the present disclosure can be effective in passively maintaining a cargo temperature within a desired temperature range in both hot and cold climates. In other experiments, a passive temperature controlled container 200 has been found to passively maintain the temperature of cargo stored in the storage chamber 102 within a desired temperature range for upwards of ten days.

While certain embodiments of the disclosed technology have been described in connection with what is presently considered to be the most practical embodiments, it is to be understood that the disclosed technology is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

Figure 14:
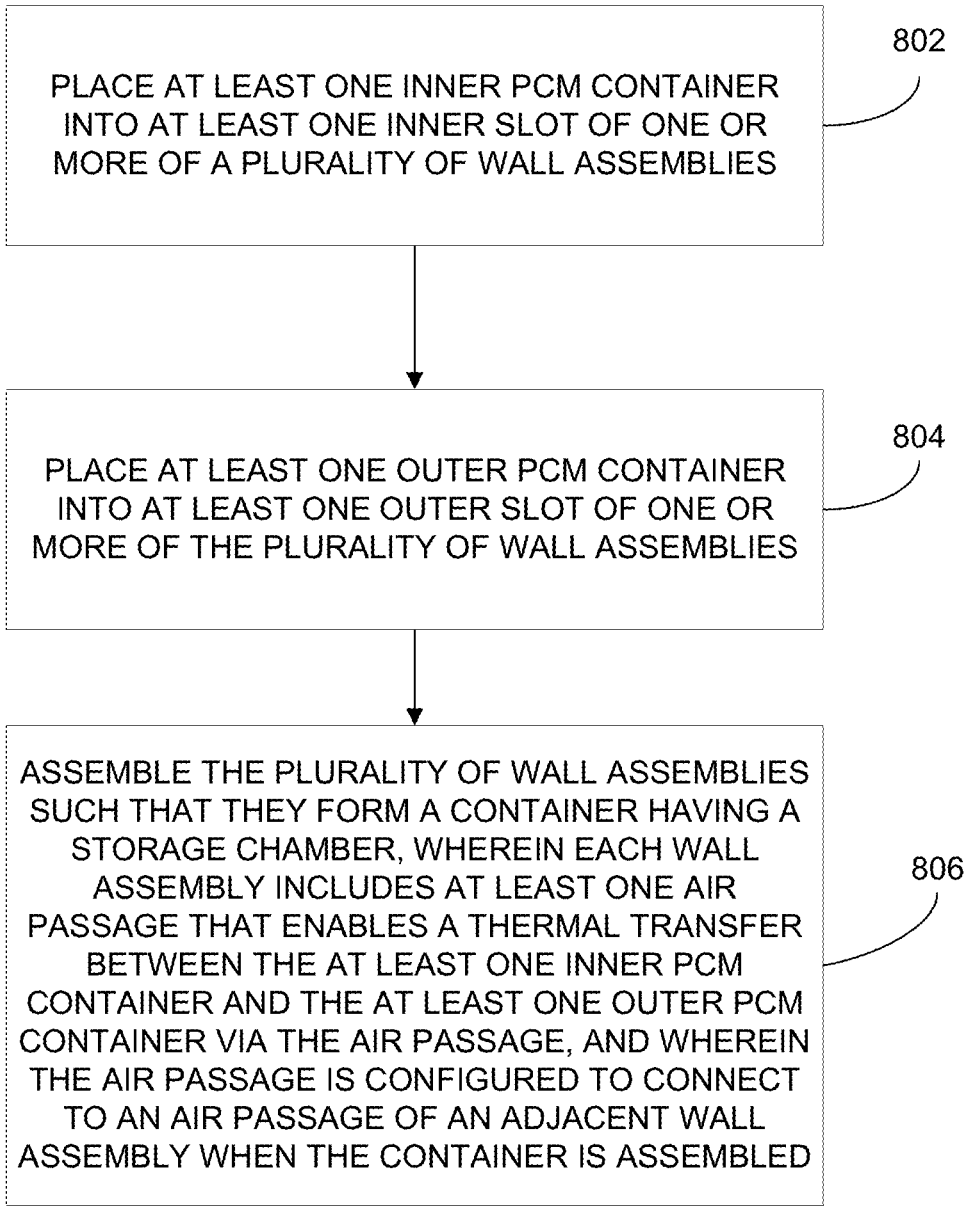
FIG. 14 is a flow diagram of a method of the present disclosure, according to an example embodiment.

FIG. 14 is a flow diagram of a method 800 of the present disclosure. For example, the method 800 may include using a passive temperature controlled container 200 to passively maintain a predetermined temperature in a storage chamber of a container for at least a specified period of time, according to an example implementation. It should be understood that maintaining a predetermined temperature may mean maintaining an approximate temperature. In some embodiments, an approximate temperature may be, for example, a temperature within a range of between 2° C. to 8° C. As described above, a passive temperature controlled container 200 may utilize many different configurations and materials to achieve different desired temperatures and temperature ranges, so it should be generally understood that container may be used to maintain a predetermined temperature that meets the temperature requirements for storing and shipping a particular good. As shown in FIG. 14, and according to an example implementation, the method 800 can include placing 802 at least one inner PCM container into at least one inner slot of one or more of a plurality of wall assemblies. The method 800 can include placing 804 at least one outer PCM container into at least one outer slot of one or more of the plurality of wall assemblies. The method 800 can include assembling 806 the plurality of wall assemblies such that they form a container having a storage chamber, wherein each wall assembly includes at least one air passage that enables a thermal transfer between the at least one inner PCM container and the at least one outer PCM container via air of the air passage, and wherein the air passage is configured to connect to an air passage of an adjacent wall assembly when the container is assembled.

Certain implementations of the disclosed technology are described above with reference to flow diagrams of methods according to example implementations of the disclosed technology. It will be understood that some blocks of the flow diagrams may not necessarily need to be performed in the order presented, or may not necessarily need to be performed at all, according to some implementations of the disclosed technology.

This written description uses examples to disclose certain embodiments of the disclosed technology, including the best mode, and also to enable any person skilled in the art to practice certain embodiments of the disclosed technology, including making and using any devices or systems and performing any incorporated methods. The patentable scope of certain embodiments of the disclosed technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A container comprising:

a plurality of wall assemblies comprising a top wall assembly, a base wall assembly, and a plurality of side wall assemblies, each side wall assembly configured to align with one or more adjacent side wall assemblies to form a substantially enclosed shape, each side wall assembly comprising:

at least one latitudinally-extending air chamber configured to allow air to flow in a latitudinal direction across the side wall assembly, each latitudinally-extending air chamber being configured to be in fluid communication with a latitudinally-extending air chamber of an adjacent center piece of a corresponding side wall assembly to allow air to flow between adjacent side wall assemblies when the container is assembled; and at least one longitudinally-extending air chamber configured to allow air to flow in a longitudinal direction across the side wall assembly, each longitudinally-extending air chamber comprising a slot configured to receive a refrigerant container.

2. The container of claim 1, wherein at least one of the plurality of wall assemblies comprises:

a first receiving portion configured to receive a first refrigerant;

a second receiving portion configured to receive a second refrigerant; and at least one air chamber disposed between the first receiving portion and the second receiving portion.

3. The container of claim 2, wherein:

each side wall assembly comprises a center piece that comprises the latitudinally-extending air chamber, an inner face, and an outer face, and each side wall assembly further comprises:

an inner panel configured to cover the inner face; and an outer panel configured to cover the outer face, the first receiving portion being disposed between the center piece and the inner panel and the second receiving portion being disposed between the center piece and the outer panel.

4. The container of claim 3, wherein the first refrigerant is disposed within a first refrigerant container and the first receiving portion is configured to receive the first refrigerant container.

5. The container of claim 3, wherein the second refrigerant is disposed within a second refrigerant container and the second receiving portion is configured to receive the second refrigerant container.

6. The container of claim 3, wherein:

the first refrigerant is disposed within a plurality of inner refrigerant containers, the second refrigerant is disposed within a plurality of outer refrigerant containers, and each of the plurality of side wall assemblies comprises:

at least one inner slot configured to receive an inner refrigerant container of the plurality of inner refrigerant containers, the inner slot being disposed between the inner face of the center piece and the inner panel; and at least one longitudinally-extending chamber, the longitudinally-extending chamber being disposed between the outer face of the center piece and the outer panel such that the at least one longitudinally-extending chamber allows air to flow in a longitudinal direction along the respective side wall assembly, the longitudinally-extending chamber comprising at least one outer slot configured to receive an outer refrigerant container of the plurality of outer refrigerant containers.

7. A container comprising:

a plurality of wall assemblies comprising a top wall assembly, a base wall assembly, and a plurality of side wall assemblies, each side wall assembly configured to align with one or more adjacent side wall assemblies to form a substantially enclosed shape, at least one of the plurality of side wall assemblies comprising:

at least one latitudinally-extending air chamber configured to allow air to flow in a latitudinal direction across the side wall assembly, each latitudinally-extending air chamber being configured to be in fluid communication with a latitudinally-extending air chamber of an adjacent center piece of a corresponding side wall assembly to allow air to flow between adjacent side wall assemblies when the container is assembled;

a first receiving portion configured to receive a first refrigerant, the first refrigerant being disposed within a plurality of inner refrigerant containers;

a second receiving portion configured to receive a second refrigerant, the second refrigerant being disposed within a plurality of outer refrigerant containers;

at least one air chamber disposed between the first receiving portion and the second receiving portion;

a center piece that comprises the latitudinally-extending air chamber, an inner face, and an outer face;

an inner panel configured to cover the inner face, the first receiving portion being disposed between the center piece and the inner panel;

an outer panel configured to cover the outer face, the second receiving portion being disposed between the center piece and the outer panel;

at least one inner slot configured to receive an inner refrigerant container of the plurality of inner refrigerant containers, the inner slot being disposed between the inner face of the center piece and the inner panel; and at least one longitudinally-extending chamber, the longitudinally-extending chamber being disposed between the outer face of the center piece and the outer panel such that the at least one longitudinally-extending chamber allows air to flow in a longitudinal direction along the respective side wall assembly, the longitudinally-extending chamber comprising at least one outer slot configured to receive an outer refrigerant container of the plurality of outer refrigerant containers.

8. The container of claim 7, wherein each of the at least one longitudinally-extending chambers is disposed between the outer face of the respective center piece and a face of an outer refrigerant container.

9. The container of claim 7, wherein each of the at least one latitudinally-extending air chambers is disposed between the outer face of the center piece and a portion of a surface of one or more respective outer refrigerant containers.

10. The container of claim 8, wherein:

each of the at least one longitudinally-extending air chambers is aligned with a recessed portion of the second receiving portion to allow air flow between the top wall assembly and a side wall assembly.

11. A container comprising:

an inner chamber;

an inner layer substantially surrounding at least a portion of the inner chamber, the inner layer configured to receive one or more inner phase change material (PCM) containers including a first PCM;

a buffer layer substantially surrounding an outer portion of the inner layer;

an air pocket layer positioned substantially around the outer portion of the inner layer, the air pocket layer comprising air; and an outer layer substantially surrounding an outer portion of the buffer layer, the outer layer comprising one or more slots, each of the one or more slots configured to receive one or more outer PCM containers including a second PCM, the outer layer further comprising a chamber in direct communication with the air pocket layer thereby causing the one or more outer PCM containers to abut the air pocket layer when the one or more slots receive the one or more outer PCM containers.

12. The container of claim 11, wherein the air pocket layer is configured to facilitate a thermal transfer between the first PCM and the second PCM.

13. The container of claim 11, wherein the buffer layer comprises a foam material or an EPS material.

14. The container of claim 11, wherein the air pocket layer is sealed within the container.

15. The container of claim 6, wherein each of the at least one longitudinally-extending chambers is disposed between the outer face of the respective center piece and a face of an outer refrigerant container.

16. The container of claim 6, wherein each of the at least one latitudinally-extending air chambers is disposed between the outer face of the center piece and a portion of a surface of one or more respective outer refrigerant containers.

17. The container of claim 15, wherein:

each of the at least one longitudinally-extending air chambers is aligned with a recessed portion of the second receiving portion to allow air flow between the top wall assembly and a side wall assembly.

* * * * *